US010913263B2

(12) United States Patent
Hasegawa et al.

(10) Patent No.: US 10,913,263 B2
(45) Date of Patent: Feb. 9, 2021

(54) CONTROL DEVICE CONTROLLING PRINTER PROVIDED WITH HEAD AND CARRIAGE CAPABLE OF MOVING AT A PLURALITY OF DIFFERENT SPEEDS

(71) Applicant: BROTHER KOGYO KABUSHIKI KAISHA, Aichi (JP)

(72) Inventors: Shin Hasegawa, Nagoya (JP); Masashi Kuno, Obu (JP); Shota Morikawa, Nagoya (JP); Satoru Arakane, Nagoya (JP); Yoshiharu Furuhata, Nagoya (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 0 days.

(21) Appl. No.: 16/728,095

(22) Filed: Dec. 27, 2019

(65) Prior Publication Data

US 2020/0207076 A1 Jul. 2, 2020

(30) Foreign Application Priority Data

Dec. 28, 2018 (JP) ..... 2018-248618

(51) Int. Cl.
*B41J 2/045* (2006.01)

(52) U.S. Cl.
CPC ..... *B41J 2/04508* (2013.01); *B41J 2/04536* (2013.01)

(58) Field of Classification Search
CPC ..... B41J 2/04508; B41J 2/04536
See application file for complete search history.

(56) References Cited

U.S. PATENT DOCUMENTS

2009/0322809 A1* 12/2009 Yamada ..... B41J 2/17513 347/7
2013/0194337 A1* 8/2013 Baba ..... B41J 2/07 347/14

FOREIGN PATENT DOCUMENTS

JP 2010-214726 A 9/2010

* cited by examiner

*Primary Examiner* — Lamson D Nguyen
(74) *Attorney, Agent, or Firm* — Scully, Scott, Murphy & Pressser, PC

(57) ABSTRACT

A control device includes: a memory; and a controller. A printer includes: a head; and a carriage mounting the head thereon. The controller is configured to perform: selecting first speed information from among a plurality of pieces of speed information stored in the memory, the first speed information indicating a first speed; estimating an ink pressure related value using the first speed information, the ink pressure related value indicating an ink pressure for a first type of print printing an image by ejecting ink from the head while moving the carriage at the first speed; determining whether the ink pressure related value reaches a threshold value; executing the first type of print in response to determining that the ink pressure related value does not reach the threshold value; and executing a second type of print in response to determining that the ink pressure related value reaches the threshold value.

12 Claims, 13 Drawing Sheets

FIG. 10A

THRESHOLD VALUE : -5500

SET CARRIAGE SPEED TO 0.5

| CARRIAGE SPEED | FIRST TIME | MINIMUM INK PRESSURE VALUE |
|---|---|---|
| 1 | 1 | −10000 |
| 0. 9 | 1. 1 | −9000 |
| 0. 8 | 1. 2 | −8000 |
| 0. 7 | 1. 4 | −7000 |
| 0. 6 | 1. 6 | −6000 |
| 0. 5 | 2 | −5000 |
| 0. 4 | 2. 5 | |
| 0. 3 | 3. 3 | |
| 0. 2 | 3. 3 | |
| 0. 1 | 10. 0 | |

FIG. 10B

THRESHOLD VALUE : -5500

SET MOVEMENTS FOR CARRIAGE TO TWO PASSES

| NUMBER OF MOVEMENTS FOR CARRIAGE | SECOND TIME | MINIMUM INK PRESSURE VALUE |
|---|---|---|
| 1 | 1 | −10000 |
| 2 | 2. 2 | −4000 |
| 3 | 3. 6 | −1000 |

CONTROL DEVICE CONTROLLING PRINTER PROVIDED WITH HEAD AND CARRIAGE CAPABLE OF MOVING AT A PLURALITY OF DIFFERENT SPEEDS

CROSS REFERENCE TO RELATED APPLICATION

This application claims priority from Japanese Patent Application No. 2018-248618 filed Dec. 28, 2018. The entire content of the priority application is incorporated herein by reference.

TECHNICAL FIELD

The present disclosure relates to a control device for controlling a printer provided with a head into which ink stored in receptacles is supplied via channels, and a carriage that moves while supporting the head, and more specifically to a control device for moving the carriage at a plurality of different speeds, such as a low speed and a high speed, and a program executed on the control device.

BACKGROUND

An inkjet printer known in the art is provided with: ink cartridges; ink supply tubes connected to the ink cartridges; a carriage unit connected to the ink supply tubes; and a control device. The carriage unit is provided with: buffer tanks connected to the ink supply tubes; an ejecting head having inflow ports into which ink flows from the buffer tanks; and pressure sensors that detect the pressure of ink in the inflow ports. The ejecting head has: channels in communication with the inflow ports; nozzles in communication with the channels; and piezoelectric-driven actuators that eject ink from the nozzles.

The control device described above determines the flow resistance of ink in the channels of the ejecting head on the basis of the pressure detected by the pressure sensors, and controls printing without limiting the printing duty cycle when the determined flow resistance is smaller than a threshold value. However, when the flow resistance is greater than the threshold value, the control device limits the printing duty cycle to prevent a situation in which the quantity of ink being supplied to the ejecting head is insufficient.

SUMMARY

The inkjet printer described above requires pressure sensors to determine whether the quantity of ink supplied to the ejecting head will be insufficient.

In view of the foregoing, it is an object of the present disclosure to provide a control device and a set of program instructions therefor capable of determining, without the use of pressure sensors, whether the quantity of ink supplied to the ejecting head will be insufficient in order to be able to change the mode of printing.

In order to attain the above and other objects, the present disclosure provides a control device configured to control a printer. The printer includes: a head; a carriage; and a drive source. The head is connectable via a channel to a receptacle accommodating therein ink. The head has: a plurality of nozzles; and a plurality of drive elements. The plurality of nozzles is configured to eject ink. The plurality of drive elements is provided corresponding to respective ones of the plurality of nozzles. The carriage mounts the head thereon.

The head is movable between a first position and a second position. The drive source is configured to move the carriage relative to a printing medium. The control device includes: a memory; and a controller. The memory is configured to store a plurality of pieces of speed information indicating respective ones of a plurality of speeds of the carriage and a threshold value for an ink pressure that ink exerts on the head. The controller is configured to perform: (a) acquiring; (b) selecting; (c) estimating; (d) determining; (e) executing; and (f) executing. The (a) acquiring acquires print data representing an image. The (b) selecting selects first speed information from among the plurality of pieces of speed information according to the print data. The first speed information indicates a first speed. The (c) estimating estimates an ink pressure related value using the print data and the first speed information. The ink pressure related value indicates the ink pressure for a first type of print. The first type of print prints the image in a printing area on the printing medium by ejecting ink from the head while moving the carriage from one of the first position and the second position to another of the first position and the second position at the first speed. The (d) determining determines whether the ink pressure related value reaches the threshold value. The (e) executing executes, in response to determining that the ink pressure related value does not reach the threshold value, the first type of print to print the image in the printing area on the printing medium. The (f) executing executes, in response to determining that the ink pressure related value reaches the threshold value, a second type of print to print the image in the printing area on the printing medium. The second type of print is different from the first type of print.

According to another aspect, the present disclosure provides a non-transitory computer readable storage medium storing a set of program instructions for a control device. The control device is configured to control a printer. The printer includes: a head; a carriage; and a drive source. The head is connectable via a channel to a receptacle accommodating therein ink. The head has: a plurality of nozzles; and a plurality of drive elements. The plurality of nozzles is configured to eject ink. The plurality of drive elements is provided corresponding to respective ones of the plurality of nozzles. The carriage mounts the head thereon. The head is movable between a first position and a second position. The drive source is configured to move the carriage relative to a printing medium. The control device includes: a memory; and a controller. The memory is configured to store a plurality of pieces of speed information indicating respective ones of a plurality of speeds of the carriage and a threshold value for an ink pressure that ink exerts on the head. The set of program instructions, when installed on and executed by the controller, causes the control device to perform: (a) acquiring; (b) selecting; (c) estimating; (d) determining; (e) executing; and (f) executing. The (a) acquiring acquires print data representing an image. The (b) selecting selects first speed information from among the plurality of pieces of speed information according to the print data. The first speed information indicates a first speed. The (c) estimating estimates an ink pressure related value using the print data and the first speed information. The ink pressure related value indicates the ink pressure for a first type of print. The first type of print prints the image in a printing area on the printing medium by ejecting ink from the head while moving the carriage from one of the first position and the second position to another of the first position and the second position at the first speed. The (d) determining determines whether the ink pressure related value reaches the threshold value. The (e) executing executes, in response to determining that the ink pressure related value does not reach the threshold value, the first type of print to print the image in the printing area on the printing medium. The (f) executing executes, in response to determining that the ink pressure related value reaches the threshold value, a second type of print to print the image in the printing area on the printing medium. The second type of print is different from the first type of print.

BRIEF DESCRIPTION OF THE DRAWINGS

The particular features and advantages of the disclosure as well as other objects will become apparent from the following description taken in connection with the accompanying drawings, in which:

FIG. 10A is an explanatory diagram illustrating setting of a scanning mode of the second scanning process by using a table specifying correlations among carriage speeds, first times, and minimum ink pressure values;

FIG. 10B is an explanatory diagram illustrating setting of the scanning mode of the second scanning process by using a table specifying correlations among numbers of movements for the carriage, second times, and minimum ink pressure values;

DETAILED DESCRIPTION

Hereinafter, an embodiment of the present disclosure will be described with reference to the accompanying drawings. The embodiment described below is merely an example of the present disclosure, and it would be apparent to those skilled in the art that the embodiment of the present disclosure may be modified as appropriate without departing from the spirit of the disclosure. For example, the order for executing steps in the processes described below may be modified as needed without departing from the spirit of the disclosure.

Figure 1A:
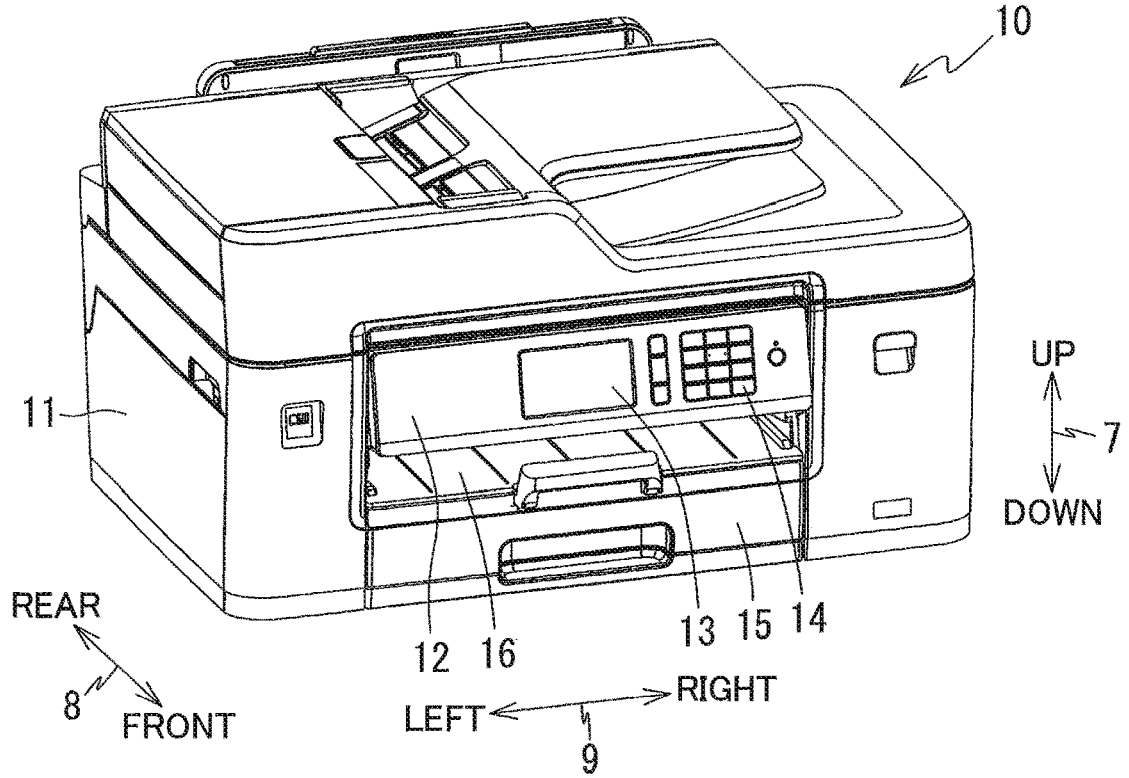
FIG. 1A is a perspective view of a printer according to one embodiment in which a cover is at a closed position.
Figure 1B:
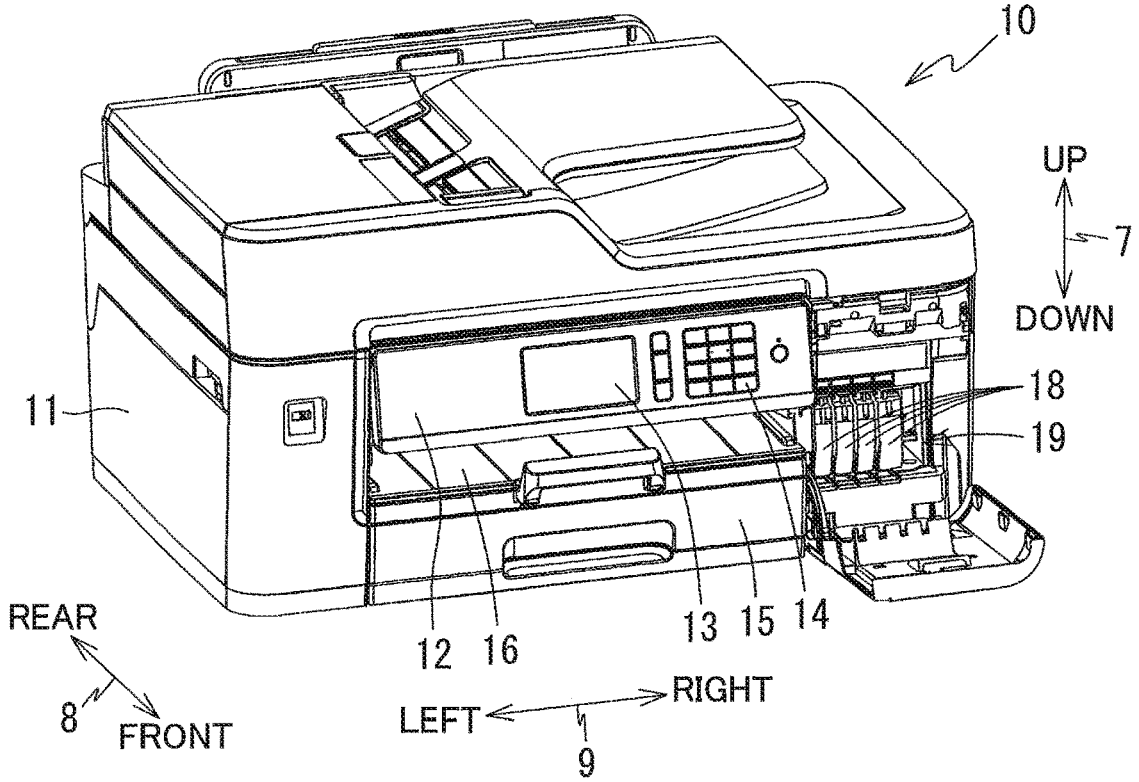
FIG. 1B is a perspective view of the printer according to the embodiment in which the cover is at an open position.

FIGS. 1A and 1B illustrate a printer 10. The printer 10 prints images on sheets 6 (see FIG. 2) as an example of the printing medium by ejecting ink onto the sheets 6. That is, the printer 10 is referred to as an inkjet printer.

While printing images on sheets 6, the printer 10 also moves a head 62 (see FIG. 2) that ejects ink. Hence, the printer 10 is also known as a serial printer.

Figure 2:
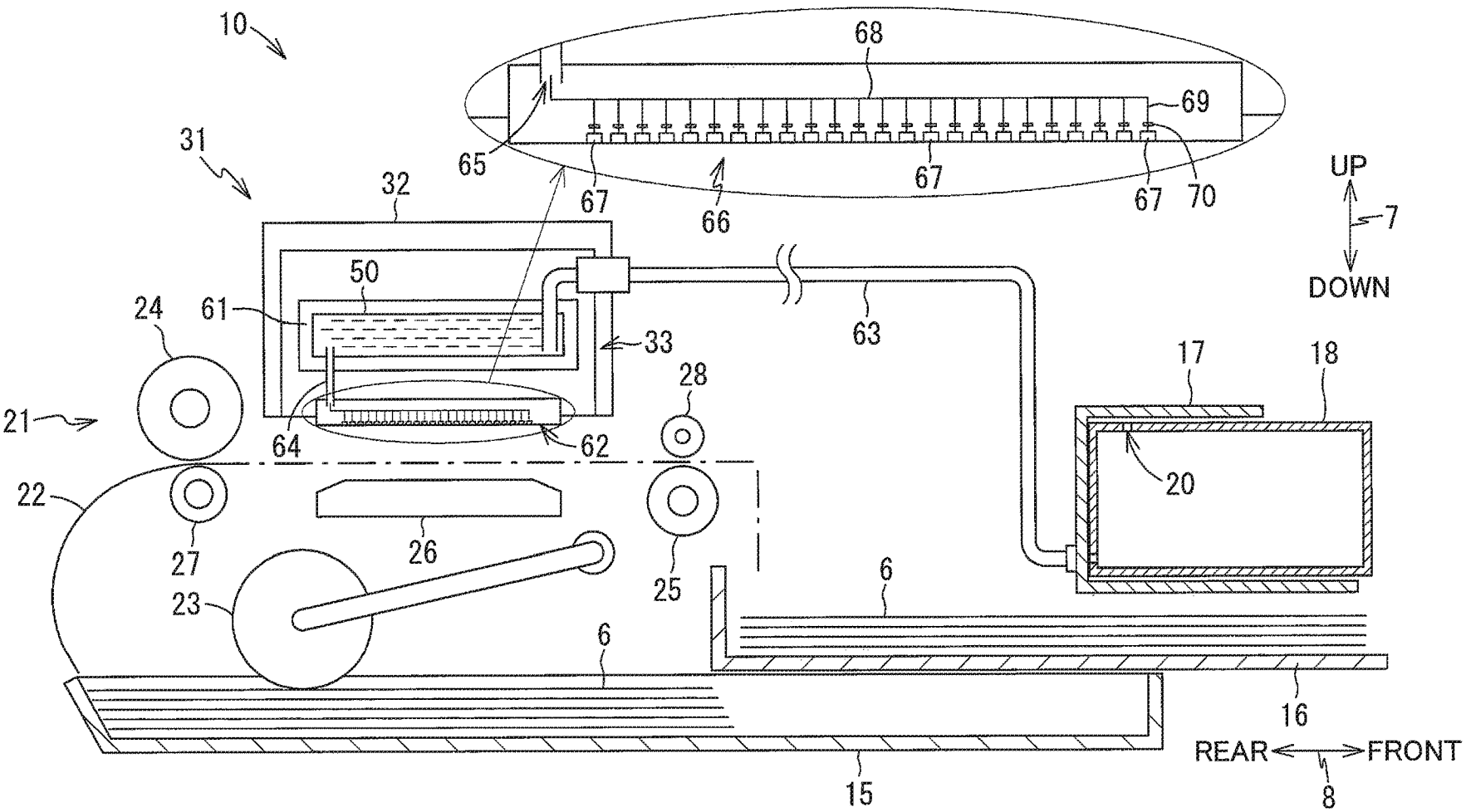
FIG. 2 is a vertical cross-sectional view schematically illustrating an internal configuration of the printer according to the embodiment.

Ink cartridges 18 (see FIG. 2) that store ink are provided in a housing 11 of the printer 10 rather than being mounted on a carriage 32 (see FIG. 2).

The printer 10 avoids situations in which the quantity of ink being supplied to the head 62 becomes insufficient while printing images on sheets 6. This aspect will be described later in greater detail.

As illustrated in FIGS. 1A and 1B, the printer 10 is provided with: the housing 11; and an operating panel 1; a feed tray 15; and a discharge tray 16 retained in the housing 11. In the example of the drawings, the operating panel 12 is disposed in the upper portion on a side surface (front surface) of the housing 11. In the following description, the side surface of the housing 11 on which the operating panel 12 is provided will be called the front surface of the printer 10. The front surface of the printer 10 is used to define front/rear directions 8. The vertical direction in FIG. 1 defines up/down directions 7, while left/right directions 9 are defined as the directions orthogonal to the front/rear directions 8 and up/down directions 7. In the example of the drawings, the feed tray 15 and discharge tray 16 are positioned below the operating panel 12.

The operating panel 12 has a display 13, and operating buttons 14. The display 13 has a liquid crystal display (LCD) screen, and film-like transparent touch sensors overlaid on the LCD screen. In other words, the display 13 is known as a touchscreen. The user inputs print commands and other instructions into the printer 10 by touching the display 13 or pressing the operating buttons 14.

As illustrated in FIG. 2, the printer 10 also has: a mounting case 17 in which the ink cartridges 18 are mounted; a conveying device 21 that conveys the sheets 6; and a printing unit 31 that prints images by ejecting ink onto the conveyed sheets 6. The mounting case 17, conveying device 21, and printing unit 31 are all housed inside the housing 11. The printing unit 31 is an example of the printer of the present disclosure.

An opening 19 is formed in the front surface of the housing 11 (see FIG. 1B). The mounting case 17 is disposed inside the housing 11 and rearward of the opening 19. The mounting case 17 has retaining parts that detachably hold each of the ink cartridges 18. The number of retaining parts provided in the mounting case 17 conforms to the type of the printer 10. For example, when the printer 10 is a monochrome printer, the mounting case 17 is provided with a single retaining part enabling only one ink cartridge 18 storing black ink to be mounted in the mounting case 17. When the printer 10 is a color printer, the mounting case 17 is provided with a plurality of retaining parts, such as four retaining parts enabling four ink cartridges 18 storing black ink, cyan ink, magenta ink, and yellow ink, for example, to be mounted in the mounting case 17. The present embodiment will describe a color printer as an example of the printer 10. Hence, a plurality of ink cartridges 18 is mounted in the mounting case 17. In the printer 10 according to the present embodiment, the mounting case 17 has four retaining parts and four ink cartridges 18 are mounted in the mounting case 17. Note that the ink stored in the ink cartridges 18 may be dye-based ink or pigment ink.

The ink cartridges 18 all have the same configuration. Each ink cartridge 18 has a box-shape with interior space for storing ink. An air communication port 20 is formed in the top portion of the outer wall constituting the ink cartridge 18 for providing communication between the interior space and the exterior of the ink cartridge 18. In other words, the interior space of the ink cartridge 18 is open to the atmosphere. The ink cartridges 18 are examples of the receptacle of the present disclosure.

The conveying device 21 is provided primarily with: a conveying path 22 along which the sheets 6 are conveyed; a feed roller 23 that feeds sheets 6 accommodated in the feed tray 15 into the conveying path 22; a conveying roller 24 and a discharge roller 25 that convey the sheets 6 along the conveying path 22; and a platen 26 that supports the sheets 6 beneath the printing unit 31.

The conveying path 22 is a space defined by a plurality of pairs of guide members (not illustrated), for example. In the example of the drawings, the conveying path 22 forms a U-shaped path that proceeds upward from the rear end of the feed tray 15, then extends forward.

The platen 26 is a member that supports the sheets 6 while the printing unit 31 to be described later prints images on the sheets 6. The platen 26 is positioned above the feed tray 15.

The feed roller 23 is disposed in a position for contacting the sheets 6 loaded in the feed tray 15. By rotating, the feed roller 23 feeds the sheets 6 from the feed tray 15 into the conveying path 22.

The conveying roller 24 is rotatably supported in a frame (not illustrated) fixed to the housing 11. The conveying roller 24 is positioned rearward of the platen 26 in the front/rear directions 8. The conveying roller 24 configures a roller pair together with a pinch roller 27. When rotating, the conveying roller 24 conveys sheets 6 along the conveying path 22.

The discharge roller 25 is rotatably supported in the frame (not illustrated) fixed to the housing 11. The discharge roller 25 is positioned forward of the platen 26 in the front/rear directions 8. The discharge roller 25 configures a roller pair together with a spur roller 28. When rotating, the discharge roller 25 conveys sheets 6 along the conveying path 22 and discharges the sheets 6 into the discharge tray 16.

Figure 5:
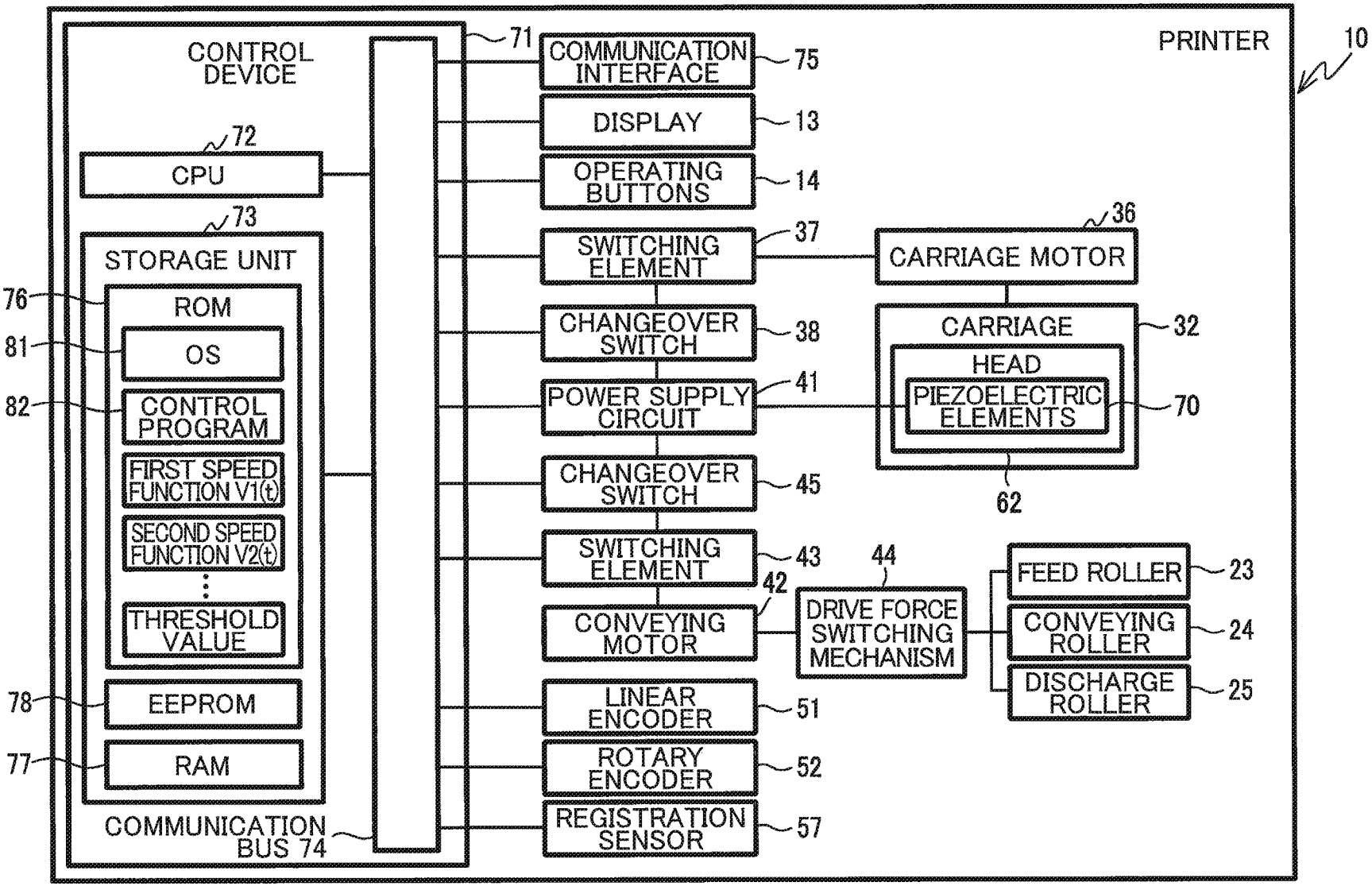
FIG. 5 is a functional block diagram of the printer including a control device according to the embodiment.

The feed roller 23, conveying roller 24, and discharge roller 25 are rotated by a conveying motor 42 (see FIG. 5). More specifically, the printer 10 is provided with the conveying motor 42, and a drive force switching mechanism 44, as illustrated in FIG. 5.

The conveying motor 42 is a DC motor that is driven to rotate when a DC voltage is supplied thereto. However, the conveying motor 42 may be an AC motor instead.

The drive force switching mechanism 44 is a gear change mechanism configured of a plurality of gears, such as a change gear and a gear train. The drive force switching mechanism 44 selectively transmits the rotational drive force of the conveying motor 42 to the feed roller 23, conveying roller 24, and discharge roller 25. Since the configuration of the drive force switching mechanism 44 is well known, a detailed description has been omitted here. Note that individual motors may be provided for rotating each of the feed roller 23, conveying roller 24, and discharge roller 25 without use of the drive force switching mechanism 44.

As illustrated in FIG. 2, the printing unit 31 is disposed above the platen 26. The printing unit 31 is provided with a carriage 32, and a printing part 33 mounted in the carriage 32.

Figure 3:
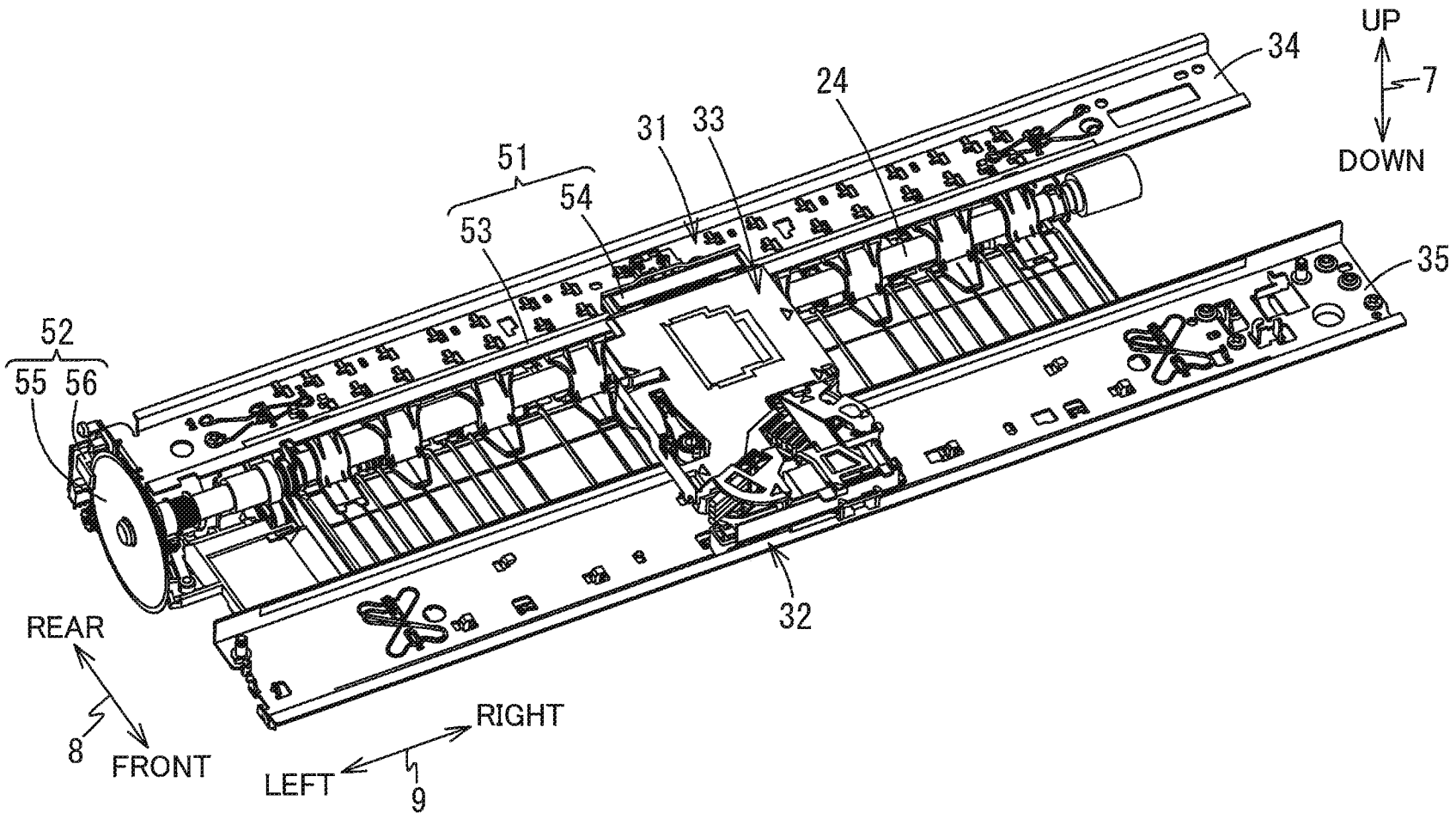
FIG. 3 is a perspective view of a printing unit provided in the printer according to the embodiment.

As illustrated in FIG. 3, the carriage 32 is supported by a pair of guide rails 34 and 35 so as to be movable along the left/right directions 9. The guide rails 34 and 35 both extend in the left/right directions 9 and are arranged apart from each other in the front/rear directions 8. [52] A moving device for moving the carriage 32 along the left/right directions 9 is provided in the printer 10. More specifically, the printer 10 is provided with a carriage motor 36 (see FIG. 5), a drive pulley driven to rotate by the carriage motor 36, a follow pulley forming a pair with the drive pulley, and an endless annular belt stretched around the drive pulley and follow pulley to configure the moving device. The carriage motor 36 is a DC motor that is driven to rotate when a DC voltage is supplied thereto. However, the carriage motor 36 may be an AC motor instead. The endless annular belt is also fixed to the carriage 32. The left/right directions 9 in which the carriage 32 moves are examples of the predetermined direction of the present disclosure. The carriage motor 36 is an example of the drive source of the present disclosure.

When the carriage motor 36 drives the drive pulley to rotate, the drive pulley moves the endless annular belt. As a result, the carriage 32 fixed to the endless annular belt is moved along the left/right directions 9.

Figures 9A, 9B:
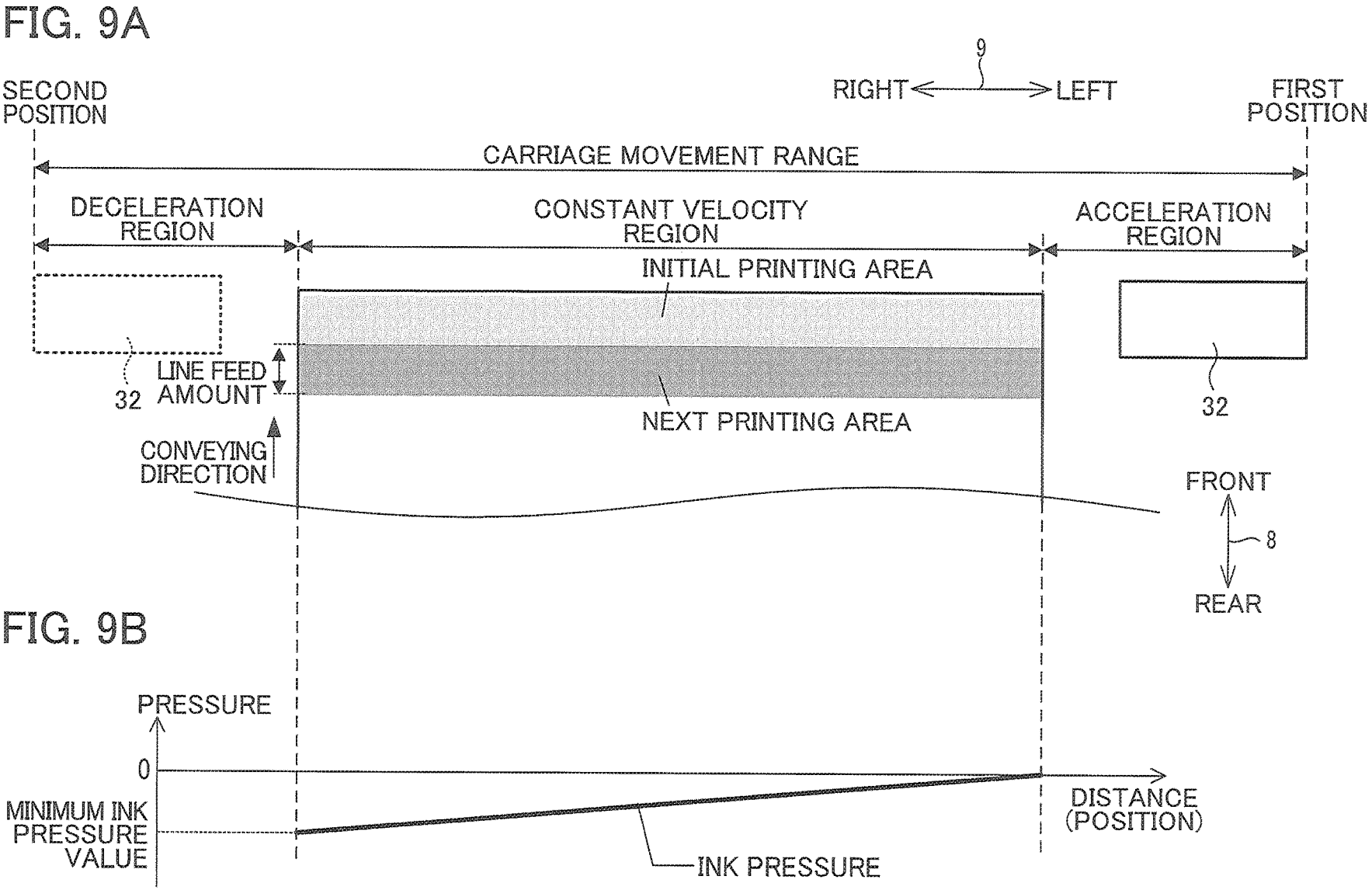
FIG. 9A is an explanatory diagram illustrating movement of a carriage in the printing unit of the printer according to the embodiment.
FIG. 9B is a graph illustrating relationship between a position of the carriage and ink pressure while the carriage moves from a first position to a second position.

The moving device described above reciprocates the carriage 32 between a first position and a second position illustrated in FIG. 9A. The first position denotes the position of the carriage 32 in the left part of the printer 10, and the second position denotes the position of the carriage 32 in the right part of the printer 10, for example. The carriage 32 is first accelerated from one of the first position and second position, and then maintained at a constant velocity, for example. Subsequently, the carriage 32 is decelerated before being halted at the other one of the first position and second position.

In FIG. 9A, the range in which the carriage 32 moves, i.e., the range between the first position and second position, is designated the "carriage movement range." The region in which the carriage 32 is accelerated during the movement of the carriage 32 from the first position to the second position is designated the "acceleration region" in FIG. 9A. The region in which the carriage 32 moves at a constant velocity is designated as the "constant velocity region" in FIG. 9A. The region in which the carriage 32 is decelerated during movement of the carriage 32 from the first position to the second position is designated the "deceleration region" in FIG. 9A. Note that during the movement of the carriage 32 from the second position to the first position, on the other hand, the carriage 32 is accelerated in the "deceleration region" of FIG. 9A, moves at a constant velocity in the "constant velocity region" of FIG. 9A, and is decelerated in the "acceleration region" of FIG. 9A.

The carriage 32 opposes the sheet 6 while in the constant velocity region, but not while in the acceleration region and deceleration region. While the carriage 32 is moving at a constant velocity, a head 62 (described later) mounted on the carriage 32 ejects ink onto the printing area of the sheet 6 to print images in the printing area (scanning process). Subsequently, the conveying roller 24 conveys the sheet 6 a prescribed conveying amount (line feed amount; line feeding process). Thereafter, the carriage 32 is again moved between the first position and second position to print an image in the next printing area (scanning process). By alternately executing the scanning process and line feeding process, the carriage 32 prints an image over the entire surface of the sheet 6. This process will be described later in greater detail. Each printing area is an example of the printing area of the present disclosure.

As illustrated in FIG. 2, the printing part 33 is provided with a buffer tank 61, and a head 62. The buffer tank 61 is formed in a box shape and has interior spaces for storing ink. The buffer tank 61 is connected to one end of each of four tubes 63. The other end of each tube 63 is connected to the mounting case 17. Hence, each interior space of the buffer tank 61 communicates with the interior space of the corresponding ink cartridge 18 mounted in the mounting case 17 via the corresponding tube 63. Ink stored in each ink cartridge 18 is supplied to the buffer tank 61 via the tube 63. The one end of the tube 63 is an example of the second end of the tube of the present disclosure. The other end of the tube 63 is an example of the first end of the tube of the present disclosure. The interior space of the tube 63 is an example of the channel of the present disclosure. Note that each tube 63 is flexible and bends as the carriage 32 moves.

The buffer tank 61 is connected to the head 62 by four channel members 64. The channel members 64 are pipes, for example, and one end (the top end) of each pipe is connected to the buffer tank 61 while the other end (the bottom end) is connected to the head 62. Ink in each color is supplied from the buffer tank 61 to the head 62 via each of the four channel members 64.

The top surface of the buffer tank 61 is open. A membrane sheet 50 is affixed to the top surface of the buffer tank 61. The membrane sheet 50 closes the opening in the top surface of the buffer tank 61.

The membrane sheet 50 has flexibility. The membrane sheet 50 flexes so as to expand upward when ink flows rapidly into the buffer tank 61 from the tube 63, and flexes so as to be recessed downward when ink flows rapidly out of the buffer tank 61 into the tube 63. By flexing in this way, the membrane sheet 50 can moderate sudden changes in ink pressure caused by ink flowing into and out of the buffer tank 61. Ink pressure denotes the pressure that ink exerts on the membrane sheet 50 on the buffer tank 61, and a manifold and nozzle channels 69 of the head 62 described later.

For example, inertial force acts on ink in the buffer tank 61 and tubes 63 owing to acceleration and deceleration of the carriage 32. This initial force acting on the ink causes ink to flow between each tube 63 and the buffer tank 61. In other words, the buffer tank 61 mitigates abrupt changes in ink pressure caused by the acceleration and deceleration of the carriage 32.

The head 62 is positioned below the buffer tank 61. The head 62 has four inflow ports 65 respectively connected to the bottom ends of the channel members 64. Ink of each color flows from the buffer tank 61 through corresponding one of the four channel members 64 into corresponding one of the four inflow ports 65.

Figure 4:
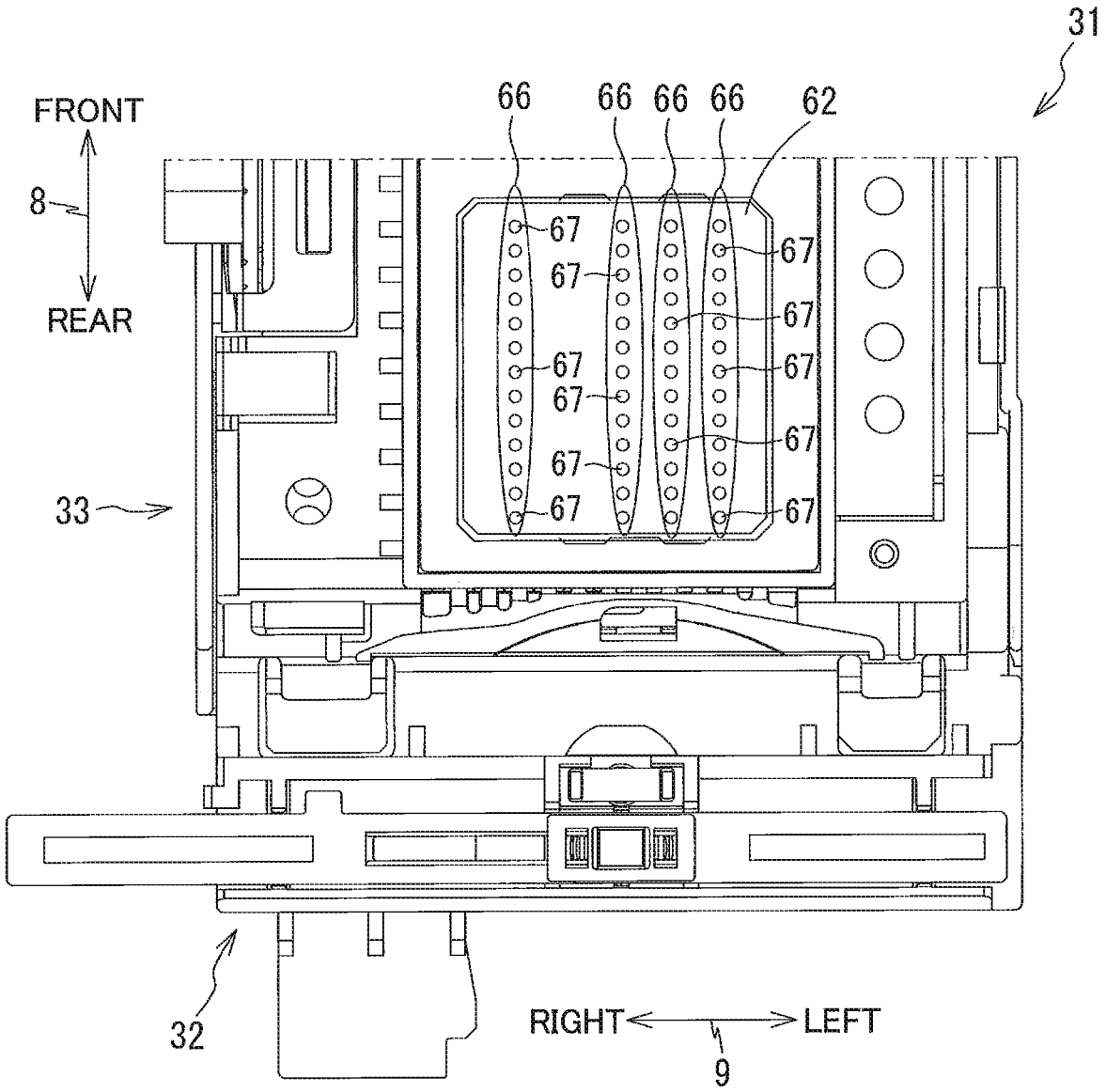
FIG. 4 is a bottom view of the printing unit having a carriage and a printing part provided in the printer according to the embodiment.

As illustrated in FIG. 4, the head 62 has four nozzle rows 66 that eject ink flowing in from the inflow ports 65. Each nozzle row 66 has a plurality of nozzles 67. Each nozzle row 66 ejects ink in one of the colors.

As illustrated in the enlarged view of FIG. 2, a single inflow port 65 is connected to a plurality of nozzles 67 in a single nozzle row 66 via a single manifold 68 and a plurality of nozzle channels 69. The structures of the manifold 68 and nozzle channels 69 are identical for each of the black, cyan, magenta, and yellow colors. Specifically, the manifold 68 and nozzle channels 69 that circulate black ink, the manifold 68 and nozzle channels 69 that circulate cyan ink, the manifold 68 and nozzle channels 69 that circulate magenta ink, and the manifold 68 and nozzle channels 69 that circulate yellow ink all have the same construction and are juxtaposed in the left/right directions 9 (the direction orthogonal to the paper surface on which FIG. 2 is drawn).

The manifold 68 extends forward in the front/rear directions 8 from the inflow port 65. The nozzle channels 69 extend downward from the manifold 68 to the bottom surface of the head 62. The openings in the nozzle channels 69 formed at the bottom surface of the head 62 constitute the nozzles 67.

The nozzle channels 69 are juxtaposed along the front/rear directions 8 and are separated from each other in the front/rear directions 8. The distance of separation between neighboring nozzle channels 69 is constant. In other words, the nozzles 67 in each nozzle row 66 are arranged at fixed intervals along the front/rear directions 8, as illustrated in FIG. 4.

As illustrated in FIG. 2, a piezoelectric element 70 is provided for each nozzle channel 69. Hence, the head 62 has a plurality of piezoelectric elements 70. The piezoelectric elements 70 deform in response to application of a DC voltage. By deforming, the piezoelectric element 70 applies pressure to ink in the corresponding nozzle channel 69, causing ink (an ink droplet) to be ejected from the corresponding nozzle 67. Lead zirconate titanate (PZT) or the like is used as the piezoelectric elements 70. The piezoelectric elements 70 is an example of the drive elements of the present disclosure. Note that heaters may be used in place of the piezoelectric elements 70 as drive elements that generate heat in response to supplied power. By generating heat, the heater rapidly vaporizes ink in the nozzle channel 69, causing ink (an ink droplet) to be ejected from the corresponding nozzle 67.

The positions of the nozzles 67 in the up/down directions 7 are higher than the levels of ink in the ink cartridges 18. Hence, atmospheric pressure does not cause ink to be ejected from the nozzles 67. The menisci of ink in the nozzles 67 prevent ink from flowing in reverse from the head 62 to the ink cartridges 18. That is, if ink menisci in the nozzles 67 break, air would be allowed to enter the head 62 through the nozzles 67, inhibiting the supply of ink from the ink cartridges 18 to the head 62.

The printer 10 is also provided with: a power supply circuit 41 that supplies power to the conveying motor 42, carriage motor 36, piezoelectric elements 70, and the like described above; a control device 71 that controls the drives of the conveying motor 42, carriage motor 36, and piezoelectric elements 70; and various sensors, switches, and the like. The control device 71 is an example of the control device of the present disclosure.

The power supply circuit 41 and control device 71 are implemented by: a control board; and ICs, microcomputers, coils, capacitors, resistors, and the like mounted on the control board, for example. That is, the printer 10 includes one or more control board units that implements the power supply circuit 41 and control device 71.

The power supply circuit 41 converts an inputted commercial AC voltage to DC voltage at a prescribed value. The power supply circuit 41 is formed in combination with a voltage regulator circuit or the like employing switching regulators, series regulators, or Zener diodes, for example. The DC voltage outputted by the power supply circuit 41 is supplied to the display 13, the control device 71, a communication interface 75 described later, the carriage motor 36, the conveying motor 42, and the like.

A changeover switch 38 and a switching element 37 are provided between the power supply circuit 41 and carriage motor 36. The changeover switch 38 switches the DC voltage supplied to the carriage motor 36 between positive and negative. That is, in response to a control signal inputted from the control device 71, the changeover switch 38 switches contacts in order to switch the DC voltage supplied to the carriage motor 36 between positive and negative. Switching the DC voltage supplied to the carriage motor 36 between positive and negative changes the direction in which the carriage motor 36 rotates. Changing the direction in which the carriage motor 36 rotates changes the direction in which the carriage 32 moves. In other words, the control device 71 controls the direction of movement for the carriage 32 by controlling the drive of the changeover switch 38. The carriage motor 36 is an example of the drive source of the present disclosure.

The switching element 37 is a metal-oxide semiconductor field-effect transistor (MOSFET), for example. The switching element 37 is switched ON and OFF in response to a drive signal of constant frequency inputted from the control device 71. By changing the duty cycle of the constant frequency drive signal inputted into the switching element 37, the control device 71 controls the power (transferred electrical energy per unit time) supplied to the carriage motor 36. In other words, the control device 71 controls the rotational speed of the carriage motor 36 through pulse-width modulation (PWM) control. The control device 71 also controls driving of the switching element 37 and changeover switch 38 in order to rotate the carriage motor 36 or halt rotation of the carriage motor 36 and to control the rotation amount of the carriage motor 36 when driving the carriage motor 36 to rotate. By controlling the amount that the carriage motor 36 is rotated, the control device 71 can control the distance that the carriage 32 is moved.

Note that use of the changeover switch 38 and switching element 37 to control the rotating direction and rotational speed of the carriage motor 36 is just one example. Control of the rotating direction and rotational speed of the carriage motor 36 may be achieved using another method.

A changeover switch 45 and a switching element 43 are provided between the power supply circuit 41 and conveying motor 42. The changeover switch 45 switches the DC voltage supplied to the conveying motor 42 between positive and negative. That is, in response to a control signal inputted from the control device 71, the changeover switch 45 switches contacts in order to switch the DC voltage supplied to the conveying motor 42 between positive and negative. Switching the DC voltage supplied to the conveying motor 42 between positive and negative changes the direction in which the conveying motor 42 rotates.

The switching element 43 is a MOSFET, for example. As with the switching element 37, the control device 71 controls the rotational speed of the conveying motor 42 through PWM control. The control device 71 also controls driving of the switching element 43 and changeover switch 45 in order to rotate the conveying motor 42 or halt rotation of the conveying motor 42 and to control the rotation amount of the conveying motor 42 when driving the conveying motor 42 to rotate. By controlling the amount that the conveying motor 42 is rotated, the control device 71 can control the amount that the sheet 6 is conveyed.

Note that use of the changeover switch 45 and switching element 43 to control the rotating direction and rotational speed of the conveying motor 42 is just one example. Control of the rotating direction and rotational speed of the conveying motor 42 may be achieved using another method.

In order that the control device 71 can accurately control the conveyed amount and position of the sheet 6, the moving distance and position of the carriage 32, and the like, the printer 10 is provided with various sensors, including a linear encoder 51, a rotary encoder 52, and a registration sensor 57.

The linear encoder 51 is a sensor that detects the position of the carriage 32. As illustrated in FIG. 3, the linear encoder 51 is provided with a reading unit 53 disposed on the guide rail 34, and a photo-interrupter 54 disposed on the carriage 32. The reading unit 53 is configured of light-transmissive parts that transmit light, and light-shielding parts that block light arranged alternately along the left/right directions 9. The photo-interrupter 54 scans the reading unit 53 as the carriage 32 moves and outputs a pulse train configured of a plurality of pulses. The pulse train outputted by the photo-interrupter 54 is inputted into the control device 71, and the control device 71 controls the drive of the carriage motor 36 on the basis of the inputted pulse train.

The rotary encoder 52 is a sensor that detects the rotational speed and rotated amount of the conveying roller 24. The rotary encoder 52 is provided with an encoder disc 55 that rotates together with the conveying roller 24, and a photo-interrupter 56. The encoder disc 55 is configured of light-transmissive parts that transmit light, and light-shielding parts that block light arranged alternately along the circumferential direction. The photo-interrupter 56 scans the encoder disc 55 as the encoder disc 55 rotates and outputs a pulse train configured of a plurality of pulses. The pulse train outputted by the photo-interrupter 56 is inputted into the control device 71, and the control device 71 controls the drive of the conveying motor 42 on the basis of the inputted pulse train.

The registration sensor 57 illustrated in FIG. 5 is disposed to the rear of the conveying roller 24 (see FIG. 2) in the front/rear directions 8. That is, the registration sensor 57 is provided at a position upstream from the conveying roller 24 in the conveying direction of the sheet 6. The registration sensor 57 has a rotary member that rotates when pushed by a sheet 6 being conveyed along the conveying path 22, and a photo-interrupter that detects the rotated position of the rotary member, for example. The voltage of the signal outputted by the registration sensor 57 changes as the leading edge of the sheet 6 passes the registration sensor 57.

The signal outputted by the registration sensor 57 is inputted into the control device 71. The control device 71 counts the number of pulses outputted by the rotary encoder 52, beginning from the point that the voltage of the signal inputted from the registration sensor 57 changes, for example. The control device 71 identifies the position of the leading edge of the sheet 6 using the count (a cumulative value) of the number of pulses. The control device 71 uses signals inputted from the registration sensor 57 and rotary encoder 52 to execute a cueing process, for example. In the cueing process, the control device 71 conveys a sheet 6 until the leading edge of the sheet 6 has reached a prescribed cueing position opposing the head 62.

As illustrated in FIG. 5, the control device 71 is provided with a central processing unit (CPU) 72, a storage unit 73, and a communication bus 74. The communication bus 74 is connected to the CPU 72, storage unit 73, display 13, switching elements 37 and 43, power supply circuit 41, and a communication interface 75. The communication interface 75 establishes a connection with a communication circuit through use of a USB cable, a local area network (LAN) cable, wireless LAN, or the like. The communication circuit is the Internet, a LAN, or the like. The printer 10 communicates with servers, portable terminals, personal computers, or other devices via the communication interface 75. The printer 10 receives print commands via the communication interface 75 from the portable terminals and personal computers, for example.

The storage unit 73 is provided with a read only memory (ROM) 76, a random access memory (RAM) 77, and an electrically erasable and programmable ROM (EEPROM) 78. The ROM 76 stores an operating system (OS) 81, and a control program 82. The control program 82 may be a single program or an aggregate of programs. The control program 82 is configured by a user interface (UI) module that receives input operations from the user, a communication module that communicates with other devices via the communication interface 75, a power supply module that controls operations of the power supply circuit 41, and a print module that controls the conveying device 21 and printing unit 31. The CPU 72 executes the plurality of programs (modules) in a pseudo-parallel manner through multitasking, for example. The CPU 72 executing the control program 82 is an example of the controller of the present disclosure. The control program 82 is an example of the set of the program instructions of the present disclosure. The storage unit 73 is an example of the memory of the present disclosure.

Hereinafter, operations of the CPU 72 executing the control program 82 may be simply described as the operations of the control program 82. For example, the description that the control program 82 performs a process means that the CPU 72 executing the control program 82 performs the process.

The ROM 76 also stores a first speed function V1(*t*), a second speed function V2(*t*), and a threshold value. The first speed function V1(*t*) and second speed function V2(*t*) are used to control the moving speed of the carriage 32 when accelerating the carriage 32, moving the carriage 32 at a constant velocity, or decelerating the carriage 32. More specifically, the control program 82 reads the first speed function V1(*t*) from the storage unit 73. Next, the control program 82 drives the switching element 37 at a prescribed duty cycle, for example. Subsequently, the control program 82 calculates the moving speed of the carriage 32 on the basis of the pulse train inputted from the linear encoder 51. The control program 82 determines how much slower or faster the moving speed at time t calculated for the carriage 32 (hereinafter called the "carriage speed") is than the speed at time t specified by the first speed function V1(*t*) (hereinafter called the "target speed"). If the control program 82 determines that the carriage speed is slower than the target speed, the control program 82 increases the duty cycle according to the difference between the carriage speed and target speed and drives the carriage motor 36 at the new duty cycle. If the control program 82 determines that the carriage speed is faster than the target speed, the control program 82 decreases the duty cycle according to the difference between the carriage speed and target speed and drives the carriage motor 36 at the new duty cycle. In other words, the control program 82 controls the drive of the carriage motor 36 so that the carriage speed matches the target speed matches the target speed specified by the first speed function V1(*t*). The second speed function V2(*t*) is used in the same way as the first speed function V1(*t*).

The first speed function V1(*t*) is used when the user has selected "normal print," for example. The second speed function V2(*t*) is used when the user has selected "high-quality print," for example. The carriage speed specified by the second speed function V2(*t*) is slower than the carriage speed specified by the first speed function V1(*t*). Hence, the carriage 32 moves at a slower speed when high-quality print has been selected than when normal print has been selected. By moving the carriage 32 at a slow speed, a high-quality image having a large number of pixels can be printed.

Figure 6:
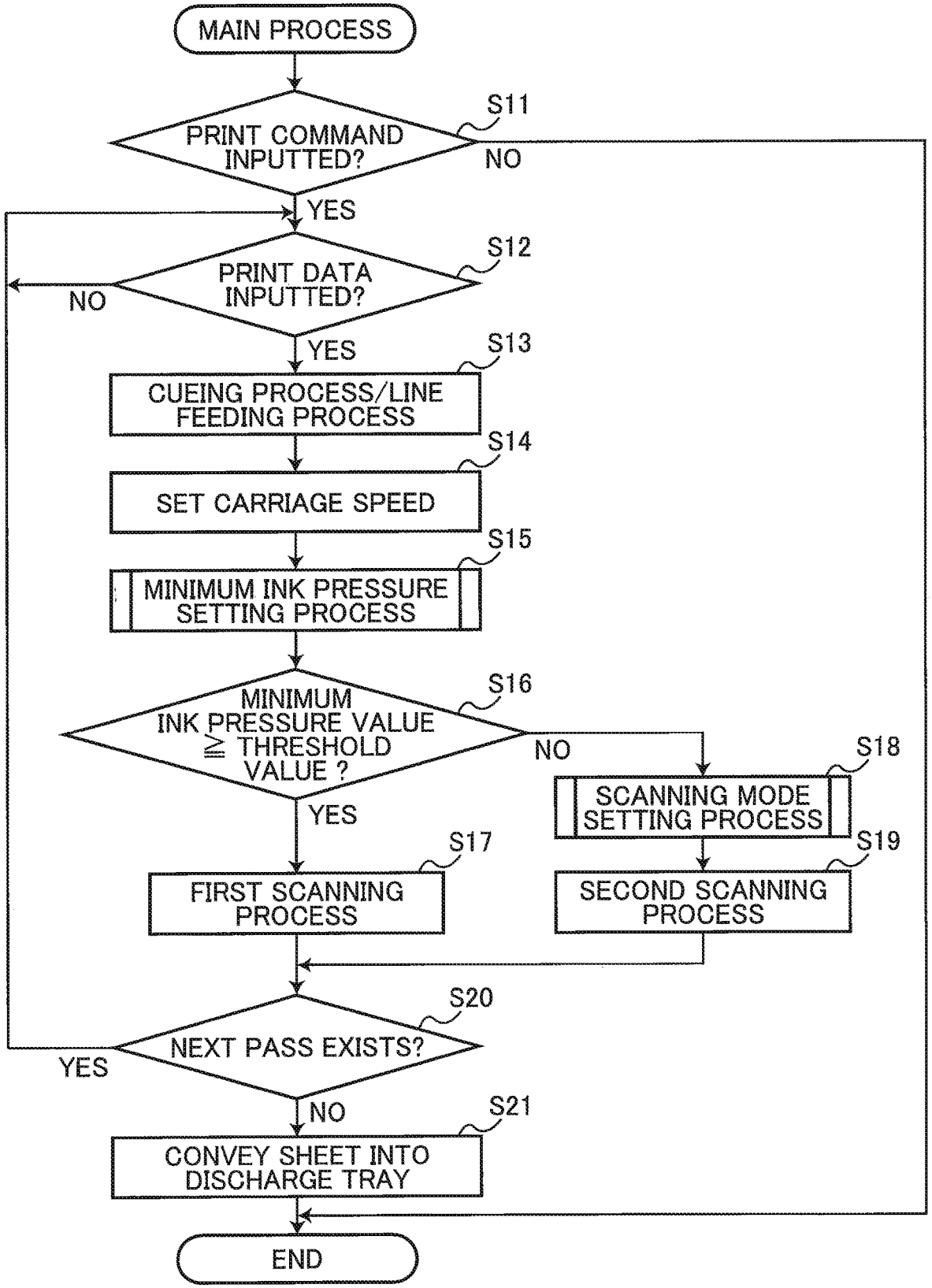
FIG. 6 is a flowchart illustrating steps in a main process executed by a CPU in the control device of the printer according to the embodiment.

The print setting "normal print" is pre-stored in the storage unit 73 in association with "first speed function V1(*t*)," and the print setting "high-quality print" is pre-stored in the storage unit 73 in association with "second speed function V2(*t*)." A print setting such as normal print and high-quality print is included in print data inputted into the printer 10 (see FIG. 6). The first speed function V1(*t*) and second speed function V2(*t*) are examples of speed information of the present disclosure.

In addition to the first speed function V1(*t*) and second speed function V2(*t*), the ROM 76 stores a plurality of other speed functions. The other speed functions are used for moving the carriage 32 at a speed slower than the first speed function V1(*t*) in order to prevent the quantity of ink supplied to the head 62 from becoming insufficient. This aspect will be described later in greater detail. Here, the second speed function V2(*t*) may be one of the plurality of other speed functions.

A threshold value is used for determining whether the quantity of ink supplied to the head 62 will be insufficient. This process will be described later in greater detail. Note that the first speed function V1(*t*), second speed function V2(*t*), other speed functions, and threshold value may be stored in the EEPROM 78 rather than the ROM 76. Further, the first speed function V1(*t*), second speed function V2(*t*), other speed functions, and threshold value are pre-stored in the storage unit 73 prior to shipping the printer 10.

The RAM 77 temporarily stores data and the like required for executing the OS 81 and control program 82. The EEPROM 78 stores data and the like that should be preserved when the power for the printer 10 is turned off, for example.

Next, the process executed by the control program 82 will be described with reference to FIGS. 6, 7, 9A, 9B, 10A, and 10B. In this process, the control program 82 controls the head 62 to eject ink in order to print images on sheets 6 while preventing the quantity of ink being supplied to the head 62 from becoming insufficient.

The control program 82 executes a main process illustrated in FIG. 6. In S11 of the main process, the control program 82 determines whether a print command has been inputted. The user inputs a print command into the printer 10 using the touch sensors of the display 13 or the operating buttons 14 on the operating panel 12. Alternatively, the user may input a print command into the printer 10 via the communication interface 75 from a personal computer or a portable terminal.

If the control program 82 determines that a print command has not been inputted (S11: NO), the control program 82 ends the main process. When the control program 82 determines that a print command has been inputted (S11: YES), the control program 82 executes the process beginning from step S12. Note that the control program 82 executes the main process at fixed intervals, for example.

When the control program 82 determines that a print command has been inputted (S11: YES), in S12 the control program 82 determines whether print data has been inputted. The user inputs print data into the control device 71 via the communication interface 75 from a personal computer or a portable terminal, for example. Alternatively, the user may input the print data into the control device 71 from a portable storage medium, such as a USB memory mounted on the printer 10. When the printer 10 has a scanner, the print data may be inputted from the scanner as data for an image being copied. When the printer 10 has a fax function unit, the print data may be inputted from this fax function unit. The process to acquire print data in response to input of the print data in step S11: YES is an example of the (a) acquiring of the present disclosure.

The print data includes print settings and pass data. The print settings include settings for the type of paper, paper size, page orientation, enlargement ratio, and a setting such as normal print and high-quality print, for example. The pass data represents an image to be printed on the sheet 6 (see FIG. 9A) by moving the carriage 32 once from one of the first position and second position to the other of the first position and second position (hereinafter also called one pass worth of pass data). For example, the control program 82 sequentially acquires one pass worth of pass data from a personal computer, a portable terminal, or a USB memory. If the storage unit 73 has sufficient available capacity, the control program 82 may acquire pass data for a plurality of passes or pass data for a single page. Here, the term "pass" signifies movement of the carriage 32 from one of the first position and second position to the other of the first position and second position.

The control program 82 waits until print data is inputted (S12: NO). When the control program 82 determines that print data has been inputted and acquired (S12: YES), in S13 the control program 82 sets a cueing amount or a line feed amount using the acquired print data. The cueing amount is the conveying amount for conveying the sheet 6 until the initial printing area (see FIG. 9A) in which an image is first printed on the sheet 6 reaches a position opposing the head 62. The line feed amount is the conveying amount for conveying the sheet 6 until the next printing area (see FIG. 9A) next to the print area in which an image has been printed in a scanning process to be described later (S17, S19) reaches the position opposing the head 62.

The control program 82 then drives the conveying motor 42 to convey the sheet 6 and stops driving the conveying motor 42 when a count value for the number of pulses inputted from the rotary encoder 52 reaches a value corresponding to the cueing amount or line feed amount set above. In other words, in S13 the control program 82 executes either a cueing process or a line feeding process. The cueing process is executed prior to the initial scanning process (S17, S19) of the main process, and the line feeding process is executed prior to the second and subsequent scanning processes.

In S14 the control program 82 sets a carriage speed using the acquired print data. Specifically, when the acquired print data includes the print setting "normal print," the control program 82 reads the first speed function V1($t$) from the storage unit 73 associated with "normal print" and sets the carriage speed to the speed specified by the first speed function V1($t$). Alternatively, if the acquired print data includes the print setting "high-quality print," the control program 82 reads the second speed function V2($t$) from the storage unit 73 that is associated with "high-quality print" and sets the carriage speed to the speed specified by the second speed function V2($t$). The process of S14 for setting carriage speed is an example of the (b) selecting of the present disclosure. The carriage speed set in the process of S14 is an example of the first speed information of the present disclosure.

In S15 the control program 82 executes a minimum ink pressure setting process to set a minimum value for the pressure that ink exerts on the head 62 (hereinafter called the "minimum ink pressure value"). More specifically, after a piezoelectric element 70 deforms and ink is ejected from the nozzle 67, the piezoelectric element 70 returns to its original shape. At this time, the ink pressure, i.e., the pressure that ink exerts on the manifold 68 and nozzle channel 69, drops. This drop in ink pressure draws ink from the ink cartridge 18 into the head 62 via the buffer tank 61 until the ink pressure is restored to its original pressure (atmospheric pressure). However, if the piezoelectric element 70 is continuously driven before the ink pressure is restored to its original pressure, the pressure gradually declines. The degree to which ink pressure drops is greater when the pixel density of the image being printed is higher and the quantity of ink ejected by the head 62 per unit time is larger. The quantity of ink ejected by the head 62 per unit time is determined using the pass data included in the print data, and the carriage speed set in S14. The minimum ink pressure setting process is performed to set ink pressure based on the acquired pass data and established carriage speed and to set the minimum ink pressure value based on the established ink pressure.

Here, the minimum ink pressure setting process will be described with reference to FIG. 8A. In S31 the control program 82 first sets the drive count for each piezoelectric element 70 and the value of DC voltage to be supplied to each piezoelectric element 70 using the print data (pass data) acquired in S12. The control program 82 then calculates and acquires the number of ink dots in one pass for each nozzle row 66 on the basis of the drive count of the piezoelectric elements 70 and the voltage value supplied to the piezoelectric elements 70 (S31). The number of dots is a numerical value representing the total quantity of ink to be ejected by one nozzle row 66.

More specifically, the control program 82 sets the value of DC voltage supplied to each piezoelectric element 70 to one of "large," "medium," and "small" on the basis of the pass data acquired in S12, for example. When DC voltage having the value "large" is supplied to the piezoelectric element 70, the nozzle 67 ejects a "large" ink droplet. When DC voltage having the value "medium" is supplied to the piezoelectric element 70, the nozzle 67 ejects a "medium" ink droplet. When DC voltage having the value "small" is supplied to the piezoelectric element 70, the nozzle 67 ejects a "small" ink droplet. Here, "medium" ink droplet may be a % ($0<a<100$) of the "large" ink droplet, and the "small" ink droplet may be b % ($0<b<a$) of the "large" ink droplet. The control program 82 sets the number of ink dots to the number of "large" ink droplets to be ejected, assuming that all ink droplets are ejected as a "large" ink droplet in one pass. That is, the control program 82 calculates the number of ink dots by converting all ink droplets to be ejected by the nozzle 67 to "large" ink droplets.

In S32 the control program 82 sets the ink pressure using the number of ink dots calculated in S31 and the carriage speed set in S14. More specifically, the control program 82 uses the number of ink dots and the carriage speed to set ink pressure corresponding to the frequency of ink ejection (also known as the printing duty cycle), i.e., the quantity of ink ejected per unit time.

The ROM 76 or EEPROM 78 of the storage unit 73 stores either a table specifying correlations between ink ejection frequencies and pressures, or a formula for calculating the ink pressure from an ink ejection frequency, for example. The control program 82 calculates the ink ejection frequency (printing duty cycle) using the number of ink dots and the carriage speed and, when the storage unit 73 stores a table, reads the pressure in the table corresponding to the calculated ink ejection frequency to set the ink pressure (S32). On the other hand, when the storage unit 73 stores a formula, the control program 82 uses the formula read from the storage unit 73 to calculate the ink pressure based on the calculated ink ejection frequency (S32). Note that the method of setting ink pressure using the number of ink dots and the carriage speed is not limited to the method described above. Another method may be used for setting ink pressure based on the number of ink dots and the carriage speed.

In S33 the control program 82 sets the minimum ink pressure value to the smallest ink pressure set in S32. Subsequently, the control program 82 ends the minimum ink pressure setting process. The ink pressure and minimum ink pressure value are example of the ink pressure related value of the present disclosure. The process of S33 for setting the ink pressure and minimum ink pressure value is an example of the (c) estimating of the present disclosure.

FIGS. 9A and 9B illustrate the ink pressure set in S32. In the example of FIGS. 9A and 9B, ink pressure gradually drops as ink is ejected from the head 62 so that the ink pressure is at its lowest when the image is being printed while the carriage 32 is at the right edge of the sheet 6. In the graph illustrated in FIG. 9B, the vertical axis represents pressure and the horizontal axis indicates the position of the carriage 32. Further, ink pressure is represented as a value based on atmospheric pressure being a zero reference, and the pressure that decreases as ink is ejected is expressed as negative pressure.

After completing the minimum ink pressure setting process in S15 of FIG. 6, in S16 the control program 82 determines whether the minimum ink pressure value set in S15 is greater than or equal to the threshold value stored in the storage unit 73. The process of S16 is an example of the (d) determining of the present disclosure.

When the control program 82 determines that the minimum ink pressure value set in S15 is greater than or equal to the threshold value (S16: YES), the control program 82 executes a first scanning process in S17. However, if the control program 82 determines that the minimum ink pressure value is less than the threshold value (S16: NO), the control program 82 executes a scanning mode setting process in S18 and subsequently executes a second scanning process in S19.

The first scanning process is an example of the first type of print of the present disclosure. The second stanning process is an example of the second type of print of the present disclosure. That the minimum ink pressure value is greater than or equal to the threshold value is an example of that the ink pressure related value does not reach the threshold value of the present disclosure. That the minimum ink pressure value is less than the threshold value is an example of that the ink pressure related value reaches the threshold value of the present disclosure.

Note that the process in steps S15 and S16 is executed for each of the ink colors black, cyan magenta, and yellow. Hence, the control program 82 executes the first scanning process of S17 when determining in S16 that the minimum ink pressure value is greater than or equal to the threshold value for all ink colors and executes the second scanning process of S19 when determining that the minimum ink pressure value is less than the threshold value for even one ink color.

The threshold value is set to a value at which the quantity of ink supplied to the head 62 becomes insufficient when the minimum ink pressure value drops to this threshold value. When ink supplied to the head 62 is insufficient, printing precision degrades because a suitable quantity of ink is not ejected from the head 62, and menisci of ink in the nozzles 67 break, allowing air to enter the head 62. Specifically, the threshold value is set to a value based on the diameter of the nozzles 67. For example, the threshold value (negative value) is set to smaller values for larger diameters of nozzles 67.

The control program 82 determines whether the supply of ink to the head 62 will be insufficient on the basis of whether the established minimum ink pressure value is greater than or equal to the threshold value. The control program 82 employs a different type of scanning process (the first scanning process or second scanning process) for cases in which the quantity of ink supplied to the head 62 will be sufficient (S16: YES) and for cases in which the quantity of ink supplied to the head 62 will be insufficient (S16: NO). The second scanning process suppresses a drop in the supply of ink to the head 62 more than the first scanning process. These processes will be described below in greater detail.

The first scanning process prints an image on the sheet 6 by moving the carriage 32 once from one of the first position and second position to the other of the first position and second position at the carriage speed set in S14. The second scanning process prints an image on the sheet 6 either by moving the carriage 32 two or more times between the first position and second position or by reducing the carriage speed to a slower speed than the speed set in S14. The mode of the second scanning process, i.e., whether an image is printed on the sheet 6 by moving the carriage 32 a plurality of times or by reducing the carriage speed, is determined in the scanning mode setting process of S18.

Here, the scanning mode setting process will be described with reference to FIG. 7. In the beginning of this process, the control program 82 executes steps S41 through S46 in order to set a first time denoting the time required to print the image when the carriage speed has been slowed to a speed at which the ink supply to the head 62 is not insufficient. These steps will be described next in greater detail.

In S41 the control program 82 reads a carriage speed Wn from the storage unit 73 (where n is a natural number between 1 and 9). The ROM 76 or EEPROM 78 of the storage unit 73 stores information indicating that W1=0.1, W2=0.2, W3=0.3, W4=0.4, W5=0.5, W6=0.6, W7=0.7, W8=0.8, and W9=0.9. Here, the carriage speed used when a normal print has been selected is set as a reference speed "1", and each of the carriage speeds Wn expresses speed as a ratio of the reference speed. Hence, the carriage speed "0.9" denotes a speed 0.9 times the carriage speed used for a normal print. Carriage speeds 0.8 through 0.1 similarly express speed as a ratio of the reference speed used when the normal print has been selected. Note that the carriage speed used when normal print has been selected is the speed specified by the first speed function V1(*t*).

The initial value of n is 9. Hence, the control program 82 first reads the carriage speed W9 (0.9) from the storage unit 73. In S42 the control program 82 sets the minimum ink pressure value for the carriage speed W9 (0.9). The process of setting the minimum ink pressure value is identical to the minimum ink pressure setting process illustrated in FIG. 8A. In S43 the control program 82 determines whether the minimum ink pressure value set in S42 is greater than or equal to the threshold value stored in the storage unit 73. Thus, in S43 the control program 82 determines whether the quantity of ink supplied to the head 62 will become insufficient when the carriage speed is slowed to "0.9". If the control program 82 determines that the minimum ink pressure value set for the carriage speed W9 (0.9) is greater than or equal to the threshold value, i.e., that the ink supply to the head 62 will be sufficient at a carriage speed of "0.9" (S43: YES), in S44 the control program 82 sets the carriage speed to "0.9".

If the control program 82 determines that the minimum ink pressure value set for the carriage speed W9 (0.9) is less than the threshold value, i.e., that the quantity of ink supplied to the head 62 will be insufficient when the carriage speed is slowed to "0.9" (S43: NO), in S45 the control program 82 decrements the value of n by 1, and repeats the process from S41. Accordingly, in S41 the control program 82 reads the carriage speed W8 (0.8) from the storage unit 73.

The control program 82 sets the carriage speed Wn by repeating the process from S41 to S45. While not illustrated in the flowchart, the control program 82 sets the carriage speed to W1 (0.1) in S44 when determining that the minimum ink pressure value set for the carriage speed W2 (0.2) is less than the threshold value (S43: NO). In this way, the carriage speed Wn is set to one of the values from "0.9" to "0.1". Further, while not illustrated in the flowchart, the control program 82 resets the value of n to the initial value of "9" after executing the process in S44.

In the example illustrated in FIG. 10A, the minimum ink pressure value is −5000 when the carriage speed is "0.5", and the threshold value is −5500. Since this minimum ink pressure value is greater than or equal to the threshold value, the control program 82 sets the carriage speed to "0.5".

By setting the carriage speed to a speed slower than the carriage speed of "1" used in the first scanning process, the second scanning process reduces the ink ejection frequency (printing duty cycle) at which ink is ejected from the head 62 in exchange for increasing the time required for printing. Reducing the ink ejection frequency suppresses a drop in ink pressure, and suppressing a drop in ink pressure prevents the quantity of ink supplied to the head 62 from becoming insufficient. Thus, the second scanning process prevents a drop in printing precision, or prevents breakage of ink menisci in the nozzles 67.

Figure 7:
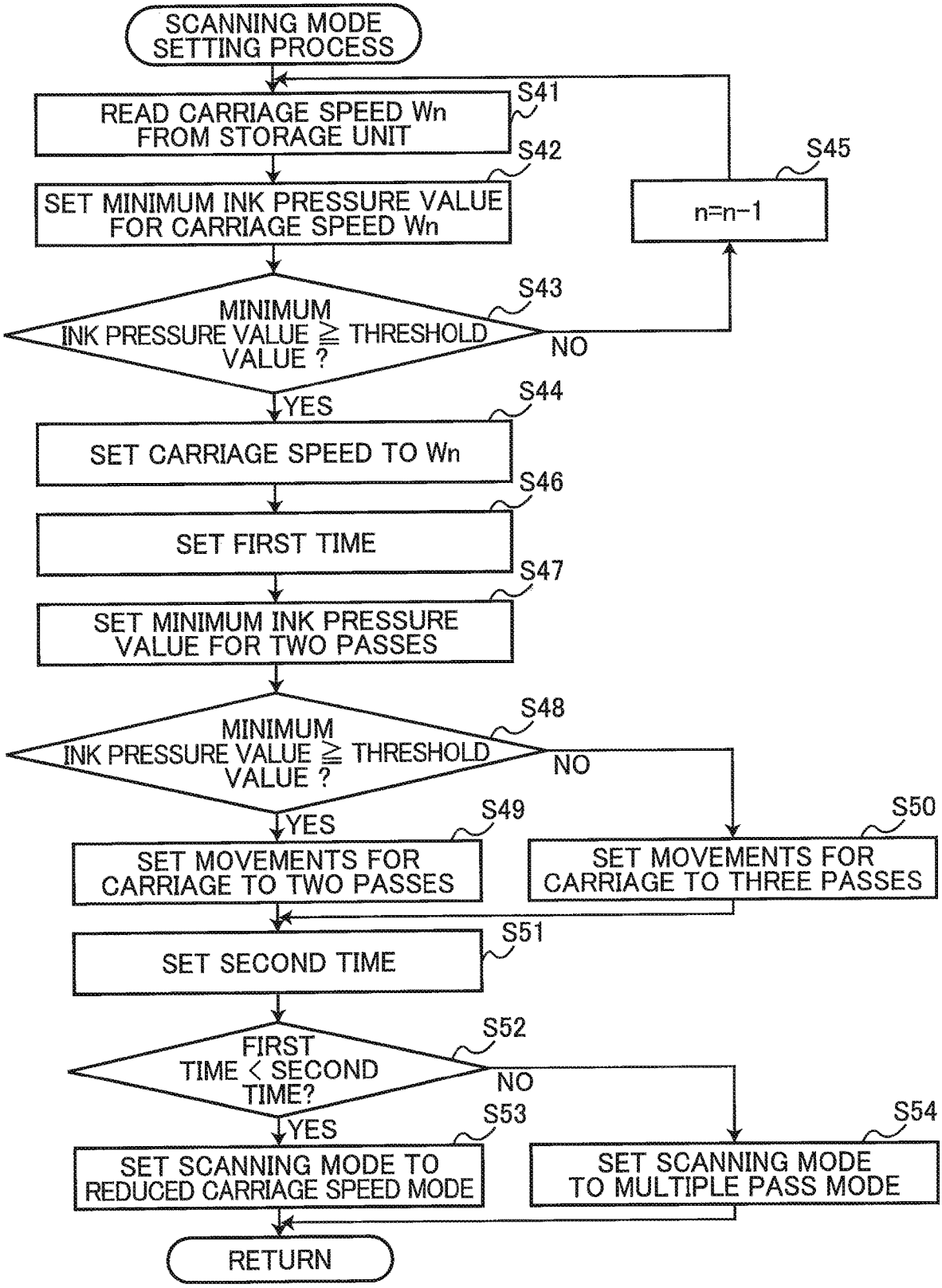
FIG. 7 is a flowchart illustrating steps in a scanning mode setting process executed by the CPU in the control device of the printer according to the embodiment.

In S46 of FIG. 7, the control program 82 sets the first time based on the carriage speed Wn set in S44. The first time is the time required for moving the carriage 32 from one of the first position and second position to the other of the first position and second position at the carriage speed set in S44. The first time may be set through calculation using the carriage speed Wn or may be selected from a table specifying correlations between carriage speeds Wn and first times. A formula for calculating the first time from a carriage speed Wn or a table specifying correlations between carriage speeds Wn and first times is pre-stored in the storage unit 73 prior to shipping the printer 10.

The first times indicated in FIG. 10A are based on a reference value of "1" representing the time required to print an image when the carriage speed is "1". For example, the first time of "1.1" denotes a time 1.1 times the time required to print an image using the carriage speed of "1". In the example of FIG. 10A, the first time is set to "2". The process of S46 for setting the first time is an example of the (h) obtaining of the present disclosure.

Note that a first time is set for each of the ink colors black, cyan, magenta, and yellow. Subsequently, the control program 82 sets the first time to the longest time set among the four ink colors.

Next, the control program 82 executes steps S47 through S51 in FIG. 7 to set a second time denoting the time required for printing an image on the sheet 6 while moving the carriage 32 two or more times between the first position and second position.

More specifically, in S47 the control program 82 sets the minimum ink pressure value for a case in which the carriage 32 is moved twice between the first position and second position, i.e., the carriage 32 is reciprocated between the first position and second position (two passes in the description of FIG. 7) at the carriage speed "1". That is, the control program 82 executes the same minimum ink pressure setting process illustrated in FIG. 8A to set the minimum ink pressure value using half the number of ink dots calculated in S31 and the carriage speed "1".

In S48 the control program 82 determines whether the minimum ink pressure value set in S47 is greater than or equal to the threshold value stored in the storage unit 73. In other words, the control program 82 determines whether the ink supply to the head 62 will become insufficient when printing an image by moving the carriage 32 twice (two movements, i.e., two passes).

When the control program 82 determines that the minimum ink pressure value set in S47 is greater than or equal to the threshold value, i.e., that the ink supply to the head 62 is sufficient (S48: YES), in S49 the control program 82 sets the number of movements for the carriage 32 to two (two passes). When the control program 82 determines that the minimum ink pressure value set in S47 is less than the threshold value, i.e., that the ink supply to the head 62 will be insufficient at two passes (S48: NO), in S50 the control program 82 sets the number of movements for the carriage 32 to three (three passes). Here, the process of S48 is performed for each of the ink colors black, cyan, magenta, and yellow. If the number of movements for the carriage 32 was set to three for even one color, the control program 82 sets the number of movements for the carriage 32 to three. If the number of movements for the carriage 32 was set to two for all colors, the control program 82 sets the number of movements for the carriage 32 to two.

Figure 8A:
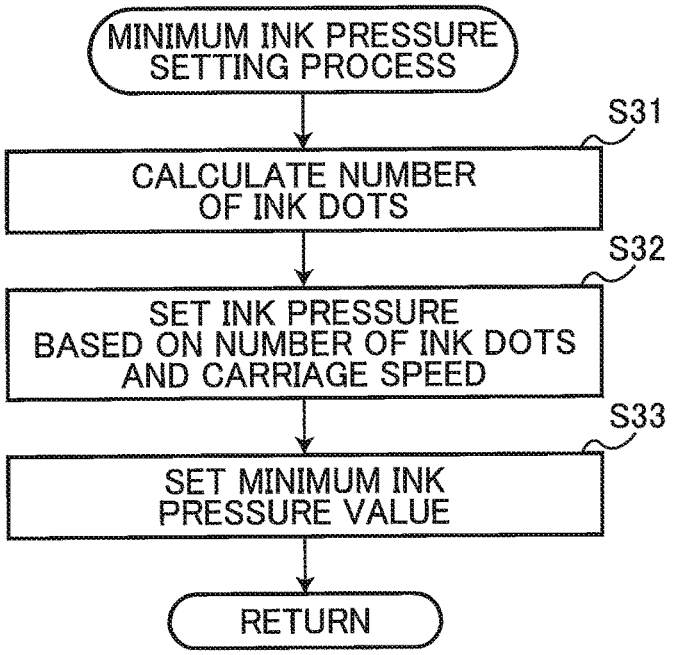
FIG. 8A is a flowchart illustrating steps in a minimum ink pressure setting process executed by the CPU in the control device of the printer according to the embodiment.

Note that if the number of movements for the carriage 32 is set to two, i.e., if the movements for the carriage 32 is set to two passes, in the second scanning process of S19 of FIG. 6 the control program 82 ejects a quantity of ink equivalent to half the number of ink dots calculated in S31 of FIG. 8A from the head 62 in one movement of the carriage 32. If the number of movements for the carriage 32 is set to three, i.e., if the movements for the carriage 32 is set to three passes, in the second scanning process of S19 of FIG. 6 the control program 82 ejects a quantity of ink equivalent to one-third the number of ink dots calculated in S31 of FIG. 8A from the head 62 in one movement of the carriage 32.

For example, if the number of movements for the carriage 32 has been set to two, the control program 82 sets nozzles 67 to be used in a first movement of the carriage 32 (also called the "firstly-executing pass") and nozzles 67 to be used in a second movement of the carriage 32 (also called the "secondly-executing pass"). The number of nozzles 67 used in the first movement of the carriage 32 is approximately equivalent to the number of nozzles 67 used in the second movement of the carriage 32. Alternatively, if the number of movements for the carriage 32 is set to two, the control program 82 sets a number of times that nozzles 67 eject ink droplets in the first movement of the carriage 32 and a number of times that nozzles 67 eject ink droplets in the second movement of the carriage 32. The number of ink droplets ejected by nozzles 67 in the first movement is substantially equivalent to the number of ink droplets ejected by nozzles 67 in the second movement.

In the example illustrated in FIG. 10B, the minimum ink pressure value for two passes is −4000 and the threshold value is −5500. Since the minimum ink pressure value is greater than or equal to the threshold value, the number of movements for the carriage 32 is set to two (the movements for the carriage 32 is set to two passes).

Dividing one printing area into multiple passes lowers the ink ejection frequency at which the head 62 ejects ink while increasing the time required for printing in comparison to the first scanning process that prints an image on the sheet 6 with one movement of the carriage 32 (one pass). Decreasing ink ejection frequency suppresses a drop in ink pressure, and suppressing a drop in ink pressure prevents the ink supply to the head 62 from becoming insufficient. Thus, this method prevents a drop in printing precision, or prevents the breakage of ink menisci in the nozzles 67.

In S51 of FIG. 7, the control program 82 sets the second time denoting the time required for printing an image using the number of movements set for the carriage 32 and the carriage speed "1". The control program 82 selects the second time from a table specifying correlations between second times and numbers of movements for the carriage 32 that is pre-stored in the ROM 76 or EEPROM 78 of the storage unit 73. Alternatively, the control program 82 may calculate the second time using the number of movements set for the carriage 32 according to a formula pre-stored in the ROM 76 or EEPROM 78 of the storage unit 73. The process of SM for setting the second time is an example of the (i) obtaining of the present disclosure.

In S52 the control program 82 determines whether the first time set in S46 is shorter than the second time set in SM. In other words, the control program 82 determines whether the time required for printing the image by slowing the carriage speed is shorter than the time required for printing the image by dividing the printing into multiple passes.

If the control program 82 determines that the first time is shorter than the second time, i.e., that the time required for printing the image is shorter when slowing carriage speed than when dividing the print into multiple passes (S52: YES), in S53 the control program 82 sets the mode for executing the second scanning process of S19 in FIG. 6 to a "reduced carriage speed" mode. However, if the control program 82 determines that the first time is not shorter than the second time, i.e., that the time required to print the image is not shorter when reducing carriage speed than when dividing printing into multiple passes (S52: NO), in S54 the control program 82 sets the mode for executing the second scanning process of S19 in FIG. 6 to a "multiple pass" mode.

In the example illustrated in FIGS. 10A and 10B, the first time of "2" is shorter than the second time of "2.2". Accordingly, the control program 82 sets the mode for the second scanning process to the "reduced carriage speed" mode.

After completing the scanning mode setting process in S18 of FIG. 6, in S19 the control program 82 executes the second scanning process. More specifically, when the "reduced carriage speed" mode was set in the scanning mode setting process, the control program 82 reads a speed function (not illustrated) corresponding to the carriage speed Wn set in S44 of FIG. 7 from the storage unit 73. A plurality of speed functions correlated with carriage speeds Wn are pre-stored in the ROM 76 or EEPROM 78 of the storage unit 73.

The control program 82 uses this speed function to control driving of the carriage motor 36. Hence, the control program 82 moves the carriage 32 at the carriage speed Wn set in S44 of FIG. 7. The control program 82 controls the head 62 to eject ink while moving the carriage 32 at a constant velocity in order to print the image on the sheet 6. In the example of FIGS. 10A and 10B, the carriage speed is set to "0.5". Accordingly, the control program 82 reads a speed function correlated with the carriage speed "0.5" from the storage unit 73 and prints an image on the sheet 6 by moving the carriage 32 according to this speed function.

On the other hand, if the "multiple pass" mode was set in the scanning mode setting process, the control program 82 reads the first speed function V1($t$) corresponding to the carriage speed "1" from the storage unit 73. In addition, the control program 82 sets nozzles 67 to be used in the first and second movements of the carriage 32 or the first, second, and third movements of the carriage 32. Alternatively, the control program 82 sets ejection numbers indicating the numbers of ink droplets that will be ejected from nozzles 67 in the first and second movements of the carriage 32 or in the first, second, and third movements of the carriage 32. Next, the control program 82 ejects ink from the nozzles 67 while moving the carriage 32 at the carriage speed "1" for the number of times set in S49 or S50 to print an image on the sheet 6.

After completing the first scanning process of S17 or the second scanning process of S19, in S20 the control program 82 determines whether a next pass exists. The existence of a next pass signifies that another printing area follows the current printing area in which an image was just printed. The control program 82 determines whether a next pass exists using the print data acquired in S12.

If the control program 82 determines that a next pass does not exist (S20: NO), in S21 the control program 82 rotates the discharge roller 25 via the conveying motor 42 in order to convey the sheet 6 into the discharge tray 16. Subsequently, the control program 82 ends the main process. When the control program 82 determines that a next pass exists (S20: YES), the control program 82 repeats the above process beginning from step S12. Note that when the print command instructs the printing of a plurality of pages, the control program 82 determines whether a next page exists and continues executing the process from S12 when a next page does exist.

Effects of the Embodiment

The control device 71 sets an ink pressure indicating the pressure that ink exerts on the head 62 using acquired print data and a set carriage speed. Hence, the control device 71 can set the ink pressure more accurately than when setting ink pressure without using a carriage speed. Thus, for a printer 10 that has a selectable carriage speed, the control device 71 can set the ink pressure accurately without using pressure sensors. Since the control device 71 can set the ink pressure accurately, the control device 71 can accurately determine whether the quantity of ink supplied to the head 62 will become insufficient.

Further, the control device 71 executes the first scanning process when the minimum ink pressure value denoting the minimum value of the established ink pressure is greater than or equal to a threshold value, and executes the second scanning process that is different from the first scanning process when the minimum ink pressure value is less than the threshold value. The threshold value is set to such a value that the quantity of ink supplied to the head 62 will be insufficient when the minimum ink pressure value is less that the threshold value. In other words, the threshold value is set to such a value that the quantity of ink supplied to the head 62 will not be insufficient when the minimum ink pressure value is greater than or equal to the threshold value. Hence, the control device 71 can change the mode of scanning being executed between cases in which the quantity of ink supplied to the head 62 is sufficient and cases in which the quantity of ink supplied to the head 62 is insufficient.

Further, the control device 71 executes the first scanning process when the minimum ink pressure value is greater than or equal to the threshold value and executes the second scanning process that better suppresses a drop in ink supply to the head 62 than the first scanning process when the minimum ink pressure value is less than the threshold value. Therefore, the control device 71 can prevent the quantity of ink supplied to the head 62 from becoming insufficient, thereby preventing a drop in printing precision or preventing ink menisci in the nozzles 67 from breaking and allowing air into the head 62.

Prior to executing the second scanning process of S19, the control device 71 also selects the one of the "reduced carriage speed" mode and "multiple pass" mode that requires less time for printing. Therefore, the control device 71 can prevent the quantity of ink supply to the head 62 from becoming insufficient while suppressing an increase in the time required for printing.

<First Variation>

The present embodiment provided above describes an example in which the control program 82 executes a second scanning process (S19) after identifying which of the "reduced carriage speed" and "multiple pass" modes requires less printing time. However, when the control program 82 determines that the minimum ink pressure value is less than the threshold value (S16: NO), the control program 82 may simply reduce the carriage speed for printing without executing the scanning mode setting process of S18. In this case, the carriage speed is set according to the same process described in S41 through S44 of FIG. 7.

Alternatively, when the control program 82 determines that the minimum ink pressure value is less than the threshold value (S16: NO), the control program 82 may perform printing using multiple movements of the carriage 32 without executing the scanning mode setting process of S18. The number of movements for the carriage 32 is set according to the same process described in S47 through S50 of FIG. 7.

Regardless of whether the "reduced carriage speed" mode or "multiple pass" mode is used in the second scanning process, an image is printed on the sheet 6 while suppressing a drop in the quantity of ink supplied to the head 62 better than in the first scanning process. Accordingly, this variation prevents a drop in printing precision, or prevents ink menisci from breaking in the nozzles 67 and allowing air to enter the head 62.

<Second Variation>

Figure 11A:
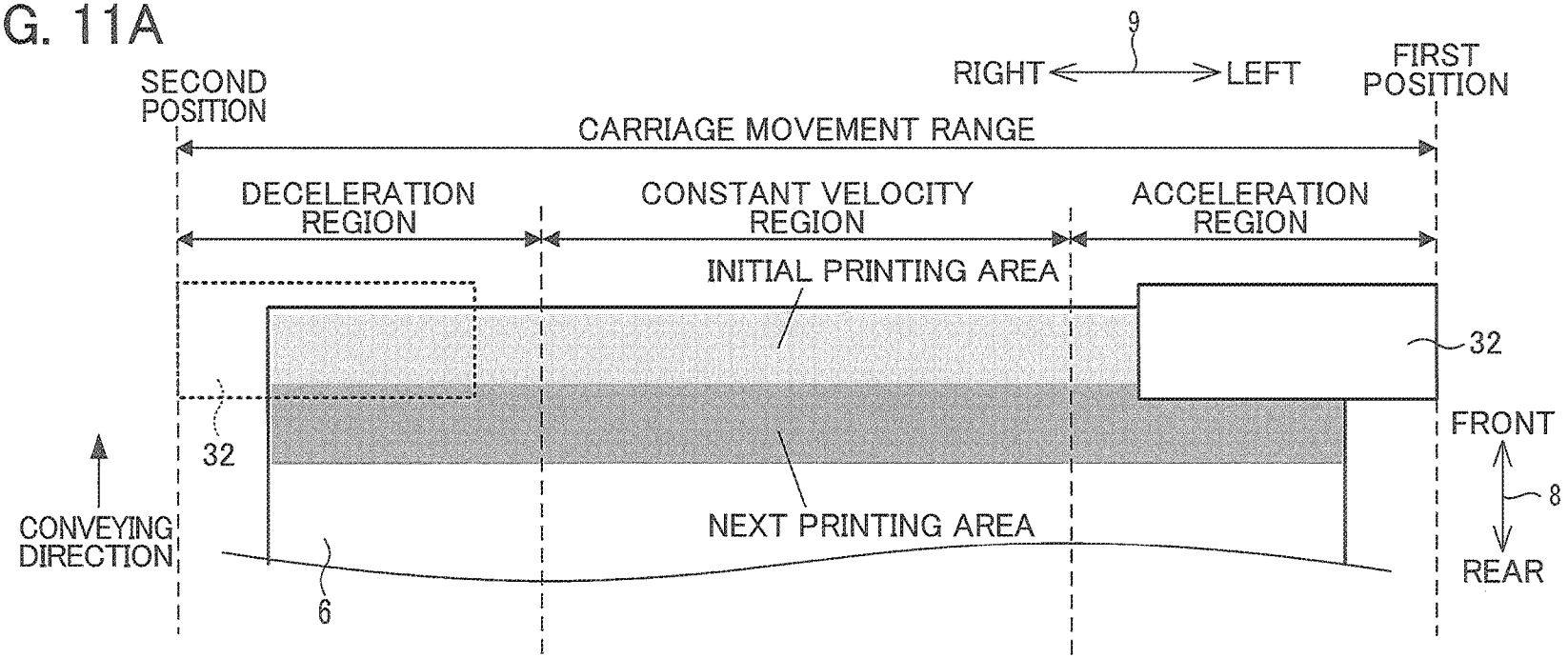
FIG. 11A is an explanatory diagram illustrating movement of a carriage in a printing unit of a printer according to a second variation.
Figure 11B:
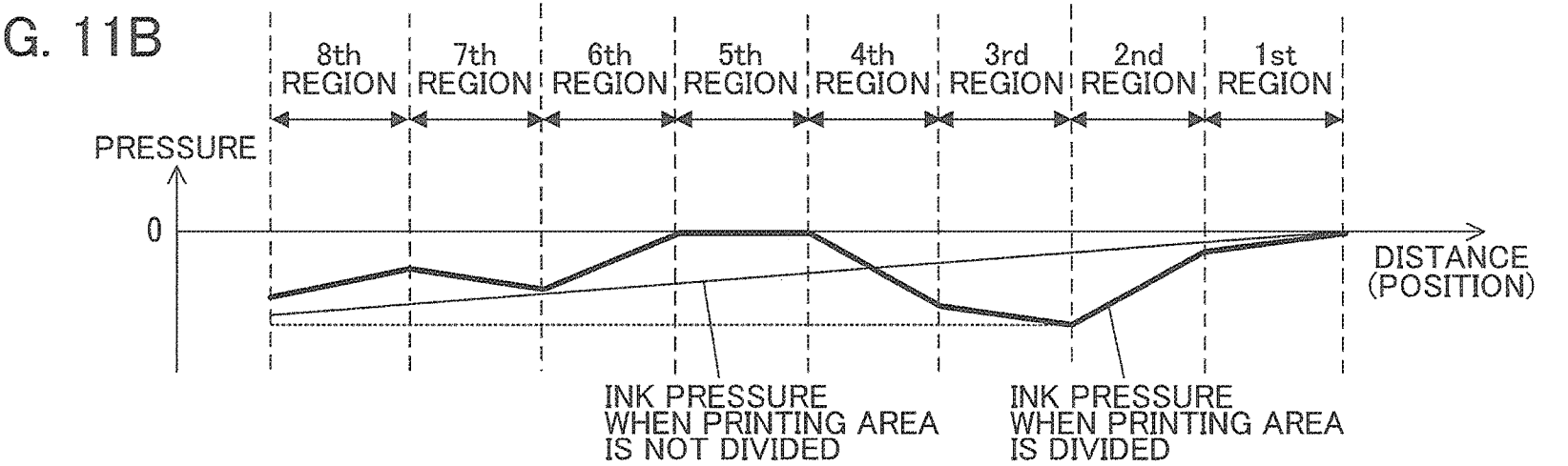
FIG. 11B is a graph illustrating relationship between a position of the carriage and ink pressure while the carriage moves from a first position to a second position.

This variation describes an example of setting ink pressure after dividing the printing area into a plurality of regions, as illustrated in FIGS. 11A and 11B. In the example of FIGS. 11A and 11B, the printing area is divided into eight regions, i.e., first through eighth regions. However, the printing area may be divided into nine or more regions or into seven or less regions, as well. Note that the description about the configuration in this variation that are equivalent to the configuration in the embodiment has been omitted here.

The control program 82 sets the ink ejection frequency (printing duty cycle) for each of the first through eighth regions using the print data acquired in S12 (see FIG. 6) and the carriage speed set in S14. As in the embodiment, the control program 82 then selects the ink pressure corresponding to the ink ejection frequency from a table pre-stored in the storage unit 73 or uses a formula pre-stored in the storage unit 73 to calculate the ink pressure based on the ink ejection frequency.

The table or formula stored in the storage unit 73 includes a pressure drop specifying the degree of drop in the pressure that ink exerts on the manifold 68 and nozzle channels 69 in the head 62, and a pressure recovery specifying the degree of recovery over elapsed time in ink pressure exerted on the manifold 68 and nozzle channels 69 of the head 62. Specifically, the degree of drop in ink pressure is larger when the quantity of ink ejected by the head 62 per unit time is greater. Ink pressure gradually recovers when the quantity of ink ejected by the head 62 per unit time is smaller or when ink is not ejected by the head 62. The table or formula stored in the storage unit 73 is configured so that ink pressure is decreased or restored on the basis of the quantity of ink ejected from the head 62 per unit time. For example, the storage unit 73 may store a linear function whose slope changes according to the ink ejection frequency. The control program 82 sets the slope of this linear function for each region according to the ink ejection frequency set for the corresponding region.

The linear function sets ink pressure for the second region using the last pressure value of ink in the first region and the linear function set for the first region. The control program 82 sets ink pressure for the third region using the last pressure value of ink in the second region and the linear function set for the second region. The control program 82 sets ink pressure similarly for the fourth through eighth regions. The last pressure value for each region is an example of the ink pressure related value of the present disclosure.

The storage unit 73 stores the linear function whose slope changes according to ink ejection frequency. The bold line in the graph of FIG. 11B depicts ink pressure when the carriage 32 moves from the first position to the second position. In the example illustrated in FIGS. 11A and 11B, ink ejection frequency in the second region is greater than ink ejection frequencies in the other regions, while ink is not ejected in the fourth region.

<Effects of the Second Variation>

In this variation, the printing area is divided into a plurality of regions (first through eighth regions), and the ink pressure is set for each region. Therefore, the minimum ink pressure value can be set more accurately than when the printing area is not divided into regions. Specifically, the fine line in FIG. 11B depicts ink pressure when the printing area is not divided into a plurality of regions. In this case, ink pressure is set using ink ejection frequency for the overall printing area, as described in the embodiment. Consequently, when the printing area includes a region in which a large quantity of ink is ejected per unit time (e.g., the second region) and a region in which ink is not ejected (e.g., the fourth region), the minimum ink pressure value will likely be set to a larger value than the actual minimum ink pressure value. Since the printing area is divided into a plurality of regions and ink pressure is set for each region in the second variation, ink pressure can be set accurately, even when the printing area includes a region in which a large quantity of ink is ejected per unit time and a region in which no ink is ejected. Since the control device 71 can set the ink pressure accurately, the control device 71 can more accurately determine whether the quantity of ink supplied to the head 62 will become insufficient. Thus, this variation prevents a drop in printing precision, or prevents ink menisci in the nozzles 67 from breaking and allowing air into the head 62.

In this variation, the control device 71 sets ink pressure for each region based on pressure drop caused by ink being ejected from the head 62 and pressure recovery as time elapses. Hence, this variation can set ink pressure more accurately than when the control device 71 sets ink pressure based solely on pressure drop caused by ink ejection and not pressure recovery as time elapses. Since the control device 71 can set ink pressure more accurately, the control device 71 can more accurately determine whether the quantity of ink supplied to the head 62 will become insufficient. Thus, this variation prevents a drop in printing precision, or prevents ink menisci in the nozzles 67 from breaking and allowing air into the head 62.

<Third Variation>

The embodiment provided above describes an example in which ink is ejected from the head 62 in order to print an image on the sheet 6 during the constant velocity region, which is the region in which the carriage 32 moves at a constant velocity. This variation will describe a case in which ink is ejected from the head 62 in order to print an image on the sheet 6 during the acceleration region in which the carriage 32 is accelerated, the constant velocity region in which the carriage 32 moves at a constant velocity, and the deceleration region in which the carriage 32 is decelerated, as illustrated in FIGS. 12A to 12D. Note that the carriage 32 moves from the first position to the second position in the example of FIGS. 12A to 12D.

When the carriage 32 is accelerated or decelerated (hereinafter also called "acceleration/deceleration"), an inertial force is applied to ink in the head 62 and the tube 63. This inertial force causes ink to flow out of the head 62 into the tube 63 or to flow into the head 62 from the tube 63. Ink pressure drops in the head 62 when ink flows out of the head 62 into the tube 63 and rises when ink flows into the head 62 from the tube 63. If ink is ejected from the head 62 after ink pressure has dropped, the quantity of ink supplied to the head 62 may be insufficient, resulting in a drop in printing precision or breakage of ink menisci in the nozzles 67.

In this variation, the control program 82 sets the ink pressure and a minimum ink pressure value according to the acceleration/deceleration of the carriage 32 in addition to the print data (pass data) acquired in S12 of FIG. 6 and the carriage speed set in S14 of FIG. 6. Specifically, the control program 82 executes the minimum ink pressure setting process illustrated in FIG. 8B in place of the minimum ink pressure setting process illustrated in FIG. 8A. This process is described next in detail, while a description about the configuration in this variation that are equivalent to the configuration in the embodiment has been omitted here.

Figure 12A:
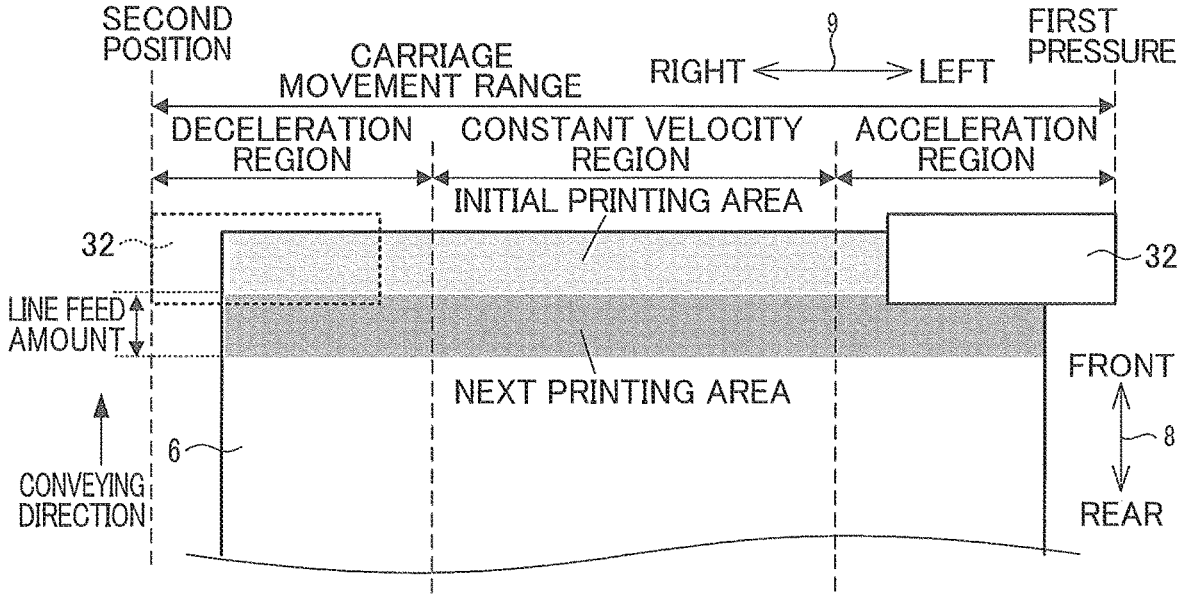
FIG. 12A is an explanatory diagram illustrating movement of a carriage in a printing unit of the printer according to the third variation.
Figure 12B:
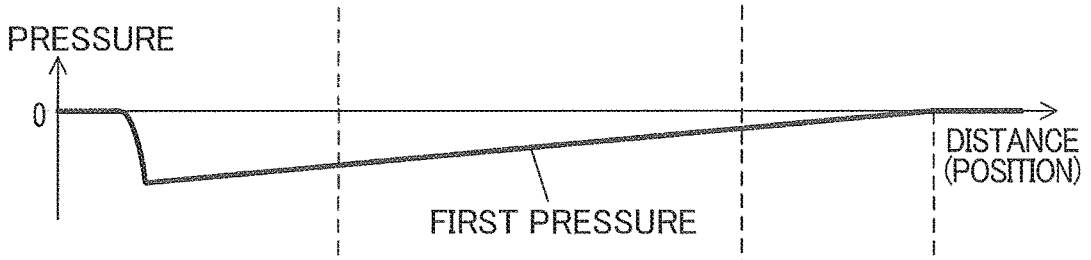
FIG. 12B is a graph illustrating relationship between a position of the carriage and a first pressure while the carriage moves from a first position to a second position.
Figure 12C:
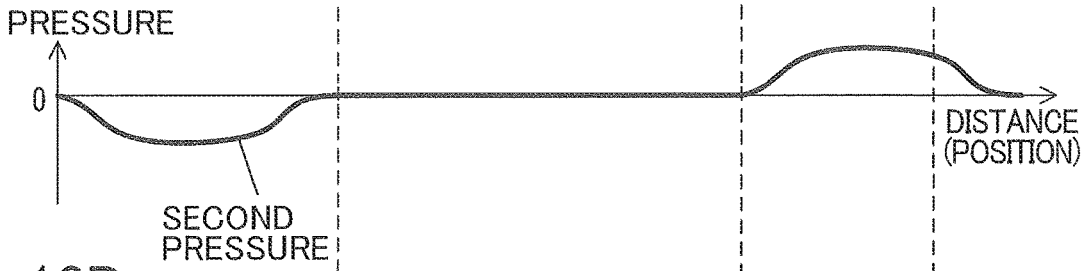
FIG. 12C is a graph illustrating relationship between the position of the carriage and a second pressure while the carriage moves from the first position to the second position.

The direction in which the carriage 32 is moved and whether the carriage 32 is accelerated or decelerated determines whether ink flows out of the head 62 to the tube 63 or flows into the head 62 from the tube 63. Thus, the control program 82 determines whether ink flows out of the head 62 to the tube 63 or flows into the head 62 from the tube 63 on the basis of the direction in which the carriage 32 moves and whether the carriage 32 is accelerated or decelerated. In the example illustrated in FIGS. 12A to 12D, ink flows from the tube 63 into the head 62 when the carriage 32 is accelerated from the first position toward the second position, and ink flows out of the head 62 toward the tube 63 when the carriage 32 is decelerated toward the second position. Pressure is represented in the graph of FIGS. 12B to 12C as a value based on atmospheric pressure being a reference value (zero). Thus, pressure in the portion of pressure drop (partial pressure) caused by ink ejection from the head 62 is expressed as negative pressure.

As in the embodiment, the control program 82 executes the process in S31 and S61 to set a first pressure. The first pressure is a pressure equivalent to a pressure drop (partial pressure) caused by ink ejection from the head 62. The first pressure corresponds to the ink pressure in the embodiment.

In S62 the control program 82 sets a second pressure indicating a pressure equivalent to a change in ink pressure (partial pressure) due to acceleration/deceleration of the carriage 32 determined by the first speed function V1($t$). The second pressure indicates the pressure after ink pressure is moderated by the membrane sheet 50 described above. The control program 82 sets the second pressure by reading a second pressure from the storage unit 73, for example. The ROM 76 or EEPROM 78 of the storage unit 73 stores two tables including a first table and a second table. The first table specifies correlations between positions of the carriage 32 in the acceleration region and second pressures, and the second table specifies correlations between positions of the carriage 32 in the deceleration region and second pressures. Alternatively, the control program 82 calculates an acceleration function A1($t$) by taking the derivative of the first speed function V1($t$) and calculates the second pressure by multiplying a prescribed coefficient by an acceleration A1($t$1) at a position x(t1) of the carriage 32 for a time t1 according to the calculated acceleration function A1($t$). The prescribed coefficient is stored in the storage unit 73 prior to shipping the printer 10.

The control program 82 finds a total ink pressure by adding the first pressure (partial pressure) to the second pressure (partial pressure) determined in S61 and S62 and sets the ink pressure to this total pressure. In S63 the control program 82 sets the minimum ink pressure value to the smallest value in the established ink pressure. Note that a "boundary position" and an "ejection halting position" illustrated in FIG. 12D will be described later in a fourth variation.

Figure 8B:
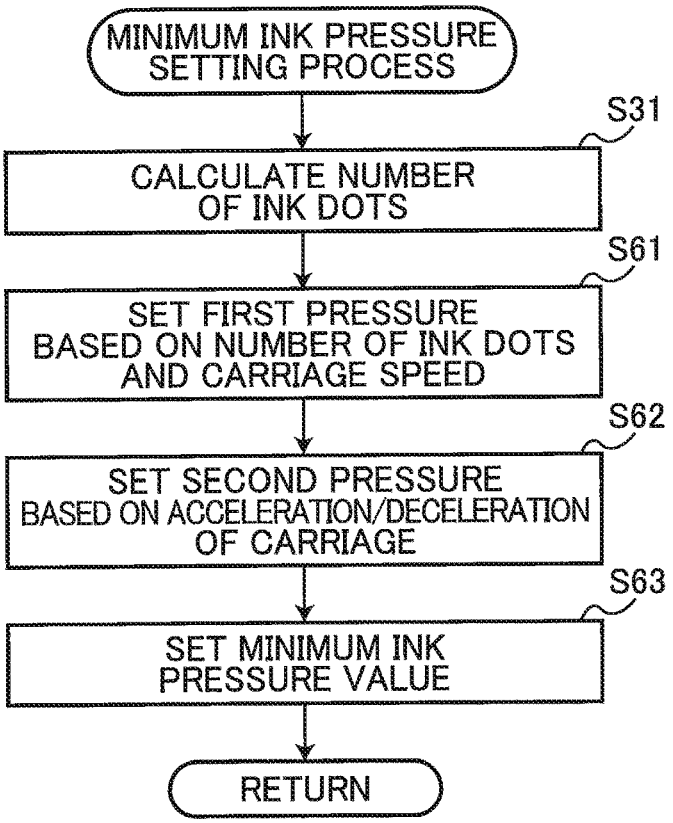
FIG. 8B is a flowchart illustrating steps in a minimum ink pressure setting process executed by a CPU in a control device of a printer according to a third variation.

After setting the minimum ink pressure value, in S16 of FIG. 6 the control program 82 determines whether the minimum ink pressure value set in S63 of FIG. 8B is greater than or equal to threshold value and continues executing the process beginning from step S16.

<Effects of the Third Variation>

In the variation described above, the ink pressure is set on the basis of acceleration/deceleration of the carriage 32 in addition to the print data (pass data) and the carriage speed. Hence, for a printer 10 that prints images on sheets 6 by ejecting ink from the head 62 even in acceleration/deceleration regions of the carriage 32, the control device 71 can set more accurate ink pressures than when ink pressure is not set on the basis of the acceleration/deceleration of the carriage 32. Since the control device 71 can set accurate ink pressure, the control device 71 can more accurately determine whether the ink supply to the head 62 will become insufficient. Thus, this variation can prevent a drop in printing precision or can prevent ink menisci in the nozzles 67 from breaking and allowing air into the head 62 for a printer 10 that prints images on sheets 6 by ejecting ink from the head 62 even in acceleration/deceleration regions of the carriage 32.

Note that the minimum ink pressure value is set as described above in S42 of FIG. 7 on the basis of acceleration/deceleration of the carriage 32 when the carriage speed is Wn. The ROM 76 or EEPROM 78 of the storage unit 73 stores two tables. The first table specifies correlations between positions of the carriage 32 in the acceleration region and second pressures for each of the carriage speed settings 0.9, 0.8, and the like. The second table specifies correlations between positions of the carriage 32 in the deceleration region and second pressures for each of the carriage speed settings 0.9, 0.8, and the like. Alternatively, the control program 82 calculates an acceleration function by taking the derivative of the speed function corresponding to the carriage speed 0.9, 0.8, and the like. Subsequently, the control program 82 calculates the second pressure by multiplying a prescribed coefficient by the acceleration of the carriage 32 specified by the acceleration function. The prescribed coefficient is stored in the storage unit 73 prior to shipping the printer 10.

<Fourth Variation>

Figure 8C:
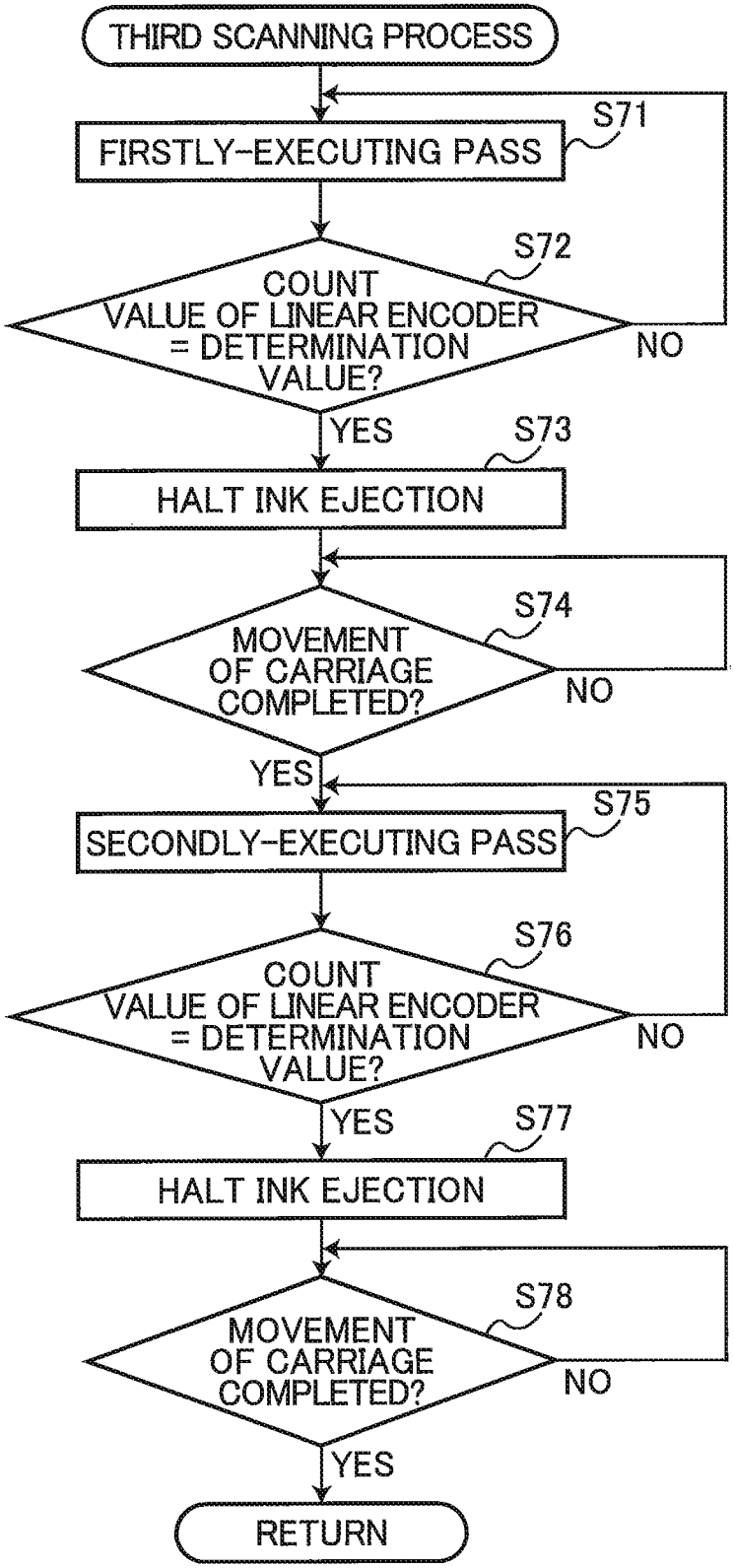
FIG. 8C is a flowchart illustrating steps in a third scanning process executed by a CPU in a control device of a printer according to a fourth variation.

In this variation, the control program 82 executes a third scanning process illustrated in FIG. 8C in place of the second scanning process illustrated in FIG. 6 when the "multiple pass" mode was set in S54 of FIG. 7 and the number of passes (the number of movements for the carriage 32) was set to "two" in S49 of FIG. 7. The third scanning process is an example of the second mode of print of the present disclosure.

More specifically, when the movements for the carriage 32 is set to two passes in the embodiment, the control program 82 sets nozzles 67 to be used in the first movement of the carriage 32 and nozzles 67 to be used in the second movement of the carriage 32. Alternatively, the control program 82 sets the number of times that ink is ejected from nozzles 67 in the first movement of the carriage 32 and the number of times that ink is ejected from nozzles 67 in the second movement of the carriage 32. When the movements for the carriage 32 is set to two passes in this variation, the printing area in which the image is to be printed is divided into a region of the image printed in the first movement of the carriage 32 and a region of the image printed in the second movement of the carriage 32. This process will be described next in greater detail.

Figure 12D:
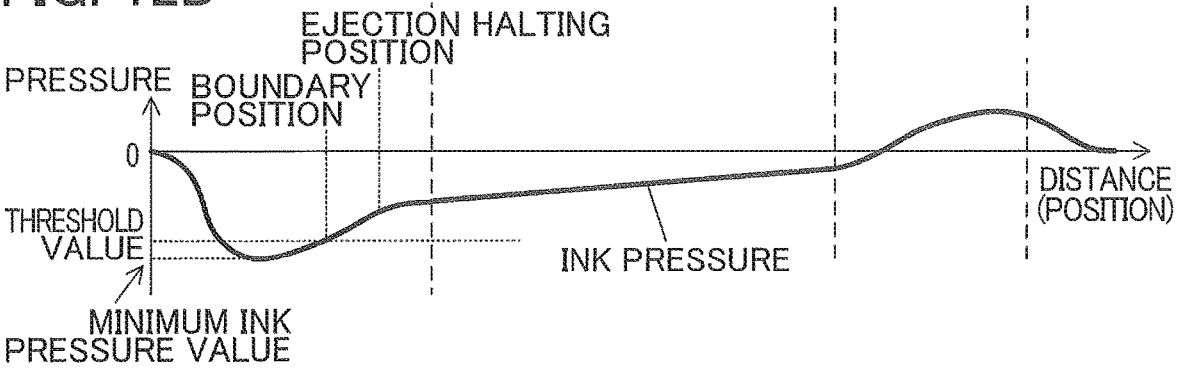
FIG. 12D is a graph illustrating relationship between the position of the carriage and ink pressure while the carriage moves from the first position to the second position.

After executing the scanning mode setting process of S18 of FIG. 6, which is illustrated in FIG. 7 and prior to executing the third scanning process of FIG. 8C, the control program 82 first sets a boundary position and an ejection halting position illustrated in FIG. 12D. The boundary position indicates the position of where the carriage reaches first when ink pressure set in S17 of FIG. 6 becomes less than the threshold value stored in the storage unit 73. The ejection halting position indicates a position behind the boundary position in the moving direction of the carriage 32 (to the left in the left/right directions 9 in the example of FIG. 9C) by a prescribed distance.

First, the control program 82 sets positions of the carriage 32 at which the ink pressure established in S15 coincides with the threshold value stored in the storage unit 73. The control program 82 then sets the boundary position to the position from among the established positions where the carriage 32 first reaches. Next, the control program 82 reads a prescribed distance from the ROM 76 or EEPROM 78 of the storage unit 73. The prescribed distance is a value pre-stored in the storage unit 73 prior to shipping the printer 10. The control program 82 then sets the ejection halting position to a position separated by the prescribed distance from the boundary position in the direction opposite the moving direction of the carriage 32. Note that the ejection halting position is set as a value corresponding to a count value for the number of pulses inputted from the linear encoder 51 (hereinafter called the "determination value").

After setting the determination value, the control program 82 executes the third scanning process illustrated in FIG. 8C. In S71 at the beginning of the third scanning process, the control program 82 executes a first movement of the carriage 32 (first scan, hereinafter called "firstly-executing pass") to move the carriage 32 from the first position to the second position while using all nozzles 67 in the head 62. In other words, in S71 the control program 82 executes the firstly-executing pass without setting nozzles 67 that are not used in the firstly-executing pass. In S72 the control program 82 counts the number of pulses inputted from the linear encoder 51 and determines whether the count value has reached the determination value described above. In other words, in S72 the control program 82 determines whether the carriage 32 has reached the ejection halting position. The firstly-executing pass is an example of the firstly-executing print of the present disclosure.

If the control program 82 determines that the count value has not yet reached the determination value (S72: NO), in S71 the control program 82 continues moving the carriage 32 for the firstly-executing pass. When the control program 82 determines that the count value has reached the determination value (S72: YES), in S73 the control program 82 halts ink ejection from the head 62 without halting movement of the carriage 32. In other words, the control program 82 prints an image in the portion of the printing area rightward of the ejection halting position.

In S74 the control program 82 determines whether the carriage 32 has arrived at the second position, completing the firstly-executing pass. While the carriage 32 has not yet reached the second position (S74: NO), the control program 82 continues moving the carriage 32 toward the second position. In other words, after halting ink ejection at the ejection halting position, the control program 82 continues moving the carriage 32 to the second position without ejecting ink from the head 62.

When the control program 82 determines that the carriage 32 has arrived at the second position, completing the firstly-executing pass (S74: YES), in S75 the control program 82 executes the second movement of the carriage 32 (second scan, hereinafter called "secondly-executing pass") for moving the carriage 32 from the second position to the first position while using all nozzles 67. In other words, in S75 the control program 82 executes the secondly-executing pass without setting nozzles 67 that are not used in the secondly-executing pass. The secondly-executing pass is an example of the secondly-executing print of the present disclosure.

In S76 the control program 82 determines whether the count value for the number of pulses inputted from the linear encoder 51 has reached the determination value. In other words, in S76 the control program 82 determines whether the carriage 32 has reached the ejection halting position. Note that when the carriage 32 is proceeding from the first position toward the second position, for example, the control program 82 counts by adding up the number of pulses inputted from the linear encoder 51. When the carriage 32 is subsequently proceeding from the second position to the first position, the control program 82 counts by subtracting the number of pulses inputted from the linear encoder 51. Therefore, the control program 82 can halt ink ejection at the same ejection halting position whether the carriage 32 is proceeding from the first position toward the second position or from the second position toward the first position.

When the control program 82 determines that the count value has not yet reached the determination value (S76: NO), the control program 82 continues executing the secondly-executing pass. However, when the control program 82 determines that the count value has reached the determination value (S76: YES), in S77 the control program 82 halts ink ejection from the head 62 without halting movement of the carriage 32. In other words, the control program 82 prints an image during the secondly-executing pass in the region of the printing area rightward of the ejection halting position, i.e., the portion not printed in the firstly-executing pass.

In S78 the control program 82 determines whether the carriage 32 has arrived at the first position, completing the secondly-executing pass. While the carriage 32 has not yet reached the first position (S78: NO), the control program 82 continues moving the carriage 32 toward the first position. In other words, after halting ink ejection at the ejection halting position, the control program 82 continues moving the carriage 32 toward the first position without ejecting ink from the head 62.

When the control program 82 determines that the carriage 32 has arrived at the second position and movement of the carriage 32 has been completed for the secondly-executing pass (S78: YES), the control program 82 ends the third scanning process and advances to S20 in the main process of FIG. 6.

Note that the fourth variation provided above describes an example in which the carriage 32 is moved from the first position to the second position in a firstly-executing pass and is subsequently moved from the second position to the first position in a secondly-executing pass. However, the carriage 32 may be moved from the second position to the first position in the firstly-executing pass and subsequently from the first position to the second position in the secondly-executing pass.

<Effects of the Fourth Variation>

In this variation, ink ejection is halted at an ejection halting position prior to the boundary position at which the supply of ink to the head 62 is expected to become insufficient. Therefore, this variation reliably prevents the ink supply to the head 62 from becoming insufficient. Here, the time that passes after ink ejection is halted in the firstly-executing pass (the first movement) of the carriage 32 and before the carriage 32 arrives at the second position and the secondly-executing pass (the second movement) of the carriage 32 begins allows the ink pressure that had dropped due to ink ejection in the firstly-executing pass to recover.

<Other Variations>

In the embodiment described above, the control device 71 of the printer 10 is described as an example of the control device of the present disclosure. However, the "control device" of the disclosure may be the control device of a personal computer or portable terminal that is connected to the printer 10 via a communication channel. In this case, the control program 82 may be a printer driver, for example. Alternatively, the control program 82 may be incorporated in the printer driver as a module.

The embodiment provided above describes a case in which the membrane sheet 50 is provided on the buffer tank 61. However, it would be apparent to those skilled in the art that various changes and modifications may be made thereto. For example, a printer not having a membrane sheet 50 provided on the buffer tank 61 may be employed in the present disclosure. When a membrane sheet 50 is not provided on the buffer tank 61, the numerical values of pressure correlated with the acceleration/deceleration of the carriage 32 in the first table and second table described above will be different values from those in the embodiment in which a membrane sheet 50 is provided on the buffer tank 61.

In the embodiment described above, the ink cartridges 18 detachably mounted in the mounting case 17 are described as examples of the receptacle of the present disclosure. However, the receptacles may be tanks fixed in the printer 10.

In the embodiment described above, the carriage motor 36 is described as an example of the drive source of the present disclosure that moves the carriage 32. However, another drive source may be employed in the present disclosure, provided that the control device 71 can control the driving.

In the embodiment described above, the minimum ink pressure value is described as an example of the ink pressure related value of the present disclosure. However, the ink pressure related value may be another value related to the pressure that ink exerts on the head 62, provided that the value can be used to determine whether the quantity of ink supplied to the head 62 will become insufficient. For example, the ink pressure related value may be the amount of negative change in ink pressure. In this case, the threshold value stored in the storage unit 73 is the absolute value of the threshold value described in the embodiment. In S18 of FIG. 6 the control program 82 determines whether the amount of negative change in ink pressure is less than or equal to the threshold value. If the amount of change is less than or equal to the threshold value (S18: YES), the control program 82 executes the first scanning process. When the amount of change is greater than the threshold value (S18: NO), the control program 82 executes the second scanning process.

In the embodiment described above, a single threshold value is stored in the storage unit 73. However, a plurality of threshold values corresponding to the ambient temperature of the printer 10, the ink viscosity, the degree of ink sedimentation, and the like may be pre-stored in the storage unit 73. For example, the printer 10 may have a temperature sensor that outputs the ambient temperature. The control program 82 reads the threshold value corresponding to the temperature outputted by the temperature sensor from the storage unit 73 and executes the process in S18 of FIG. 6. Alternatively, the control program 82 may keep track of elapsed time since the ink cartridge 18 was mounted in the mounting case 17. The ink viscosity and degree of ink sedimentation increases as time elapses. The control program 82 reads a threshold value corresponding to the elapsed time from the storage unit 73 when executing the process in S18. Alternatively, the control program 82 may revise the threshold values described in the embodiment using the ambient temperature or elapsed time described above and may execute the process in S18 using the revised threshold value. A formula for revising the threshold value may be pre-stored in the storage unit 73.

In the printer 10 according to the embodiment described above, the ink cartridges 18 are not mounted on the carriage 32. However, the ink cartridges 18 may be mounted on the carriage 32. In other words, an on-carriage printer may be employed in the present disclosure.

The embodiment provided above describes an example in which the user can select from among the two settings "normal print" in which the carriage 32 is moved at a carriage speed specified by the first speed function V1(*t*), and "high-quality print" in which the carriage 32 is moved at a carriage speed specified by the second speed function V2(*t*). However, the number of settings from which the user can select may be three or more. In other words, the user may be allowed to select from among three or more carriage speeds. In any case, the control program 82 sets the minimum ink pressure value based on the inputted print data and the carriage speed selected by the user, and compares the minimum ink pressure value to a threshold value to determine whether the quantity of ink supplied to the head 62 will become insufficient.

What is claimed is:

1. A control device configured to control a printer, the printer including: a head connectable via a channel to a receptacle accommodating therein ink, the head having: a plurality of nozzles configured to eject ink; and a plurality of drive elements provided corresponding to respective ones of the plurality of nozzles; a carriage mounting the head thereon, the head being movable between a first position and a second position; and a drive source configured to move the carriage relative to a printing medium, the control device comprising:

a memory configured to store a plurality of pieces of speed information indicating respective ones of a plurality of speeds of the carriage and a threshold value for an ink pressure that ink exerts on the head; and a controller configured to perform:

(a) acquiring print data representing an image;

(b) selecting first speed information from among the plurality of pieces of speed information according to the print data, the first speed information indicating a first speed;

(c) estimating an ink pressure related value using the print data and the first speed information, the ink pressure related value indicating the ink pressure for a first type of print, the first type of print printing the image in a printing area on the printing medium by ejecting ink from the head while moving the carriage from one of the first position and the second position to another of the first position and the second position at the first speed;

(d) determining whether the ink pressure related value reaches the threshold value;

(e) executing, in response to determining that the ink pressure related value does not reach the threshold value, the first type of print to print the image in the printing area on the printing medium; and (f) executing, in response to determining that the ink pressure related value reaches the threshold value, a second type of print to print the image in the printing area on the printing medium, the second type of print being different from the first type of print.

2. The control device according to claim 1, wherein the controller is configured to further perform:

(g) selecting, in response to determining that the ink pressure related value reaches the threshold value, second speed information from among the plurality of pieces of speed information, the second speed information indicating a second speed slower than the first speed, the ink pressure related value estimated using the second speed information not reaching the threshold value;

(h) obtaining a first time required to perform a first mode of print, the first mode of print printing the image in the printing area on the printing medium by ejecting ink from the head while moving the carriage one time at the second speed, one time movement being defined by movement of the carriage from the first position to the second position or from the second position to the first position;

(i) obtaining a second time required to perform a second mode of print, the second mode of print printing the image in the printing area on the printing medium by ejecting ink from the head while reciprocally moving the carriage at least two times at the first speed; and (j) determining whether the first time is shorter than the second time, and wherein the (f) executing executes the first mode of print as the second type of print in response to determining that the first time is shorter than the second time, and the (f) executing executes the second mode of print as the second type of print in response to determining that the first time is not shorter than the second time.

3. The control device according to claim 2, wherein the (g) selecting selects the second speed information from among at least one piece of speed information indicating respective ones of at least one speed, each of at least one ink pressure related value estimated using respective ones of the at least one speed not reaching the threshold value, the second speed being fastest among the at least one speed.

4. The control device according to claim 3, wherein the (c2) estimating comprises:

(c21) obtaining a pressure drop value and a recovery value for each of the plurality of partial prints, the pressure drop value for the first partial print specifying a pressure drop in the ink pressure during the first partial print, the recovery value for the first partial print specifying a value of the ink pressure to be recovered in a time period from completion of the first partial print to start of the second partial print; and (c22) calculating the ink pressure related value based on the pressure drop value and the recovery value for each of the plurality of partial prints.

5. The control device according to claim 1, wherein the (c) estimating comprises:

(c1) dividing the printing area into a plurality of printing regions arranged between the first position and the second position in the predetermined direction, the image being made up of a plurality of partial images arranged between the first position and the second position, a plurality of partial prints printing respective ones of the plurality of partial images, the plurality of partial prints including a first partial print and a second partial print subsequent to the first partial print, the first partial print printing a first partial image in a first printing area, the second partial print printing a second partial image in a second printing area successively positioned with respect to the first printing area; and (c2) estimating a plurality of ink pressure related values indicating the ink pressure for respective ones of the plurality of partial prints, the plurality of ink pressure related value including a first ink pressure related value for the first partial print and a second ink pressure related value for the second partial print, the second ink pressure related value being estimated using the first ink pressure related value.

6. The control device according to claim 1, wherein the printer further includes a tube having a first end connected to the receptacle and a second end connected to the head, the tube forming the channel, wherein in the (e) executing, the first type of print prints the image in the printing area on the printing medium by ejecting ink from the head while moving the carriage in a movement range between the first position and the second position, the movement range including a first region, a second region, and a third region, the carriage being accelerated in the first region, the carriage being maintained at the first speed in the second region, the carriage being decelerated in the third region, and wherein the (c) estimating estimates the ink pressure related value based on movement of the carriage in the first region and the third region.

7. The control device according to claim 1, wherein the first type of print prints the image in the printing area on the printing medium by ejecting ink from the head while moving the carriage one time, one time movement being defined by movement of the carriage from the first position to the second position or from the second position to the first position, and wherein the second type of print prints the image in the printing area on the printing medium by ejecting ink from the head while reciprocally moving the carriage at least two times.

8. The control device according to claim 7, wherein the controller is configured to further perform:

(k) specifying a boundary position at which the ink pressure related value reaches the threshold value, wherein the second type of print includes a firstly-executing print performed by moving the carriage from one of the first position and the second position and a secondly-executing print performed by moving the carriage from another of the first position and the second position, and wherein the firstly-executing print ejects ink from the head while moving the carriage from the one of the first position and the second position to a third position, halts ejecting ink from the head at the third position, and continues moving the carriage from the third position to the another of the first position and the second position without ejecting ink from the head, the third position being positioned between the first position and the boundary position, and wherein the secondly-executing print ejects ink from the head while moving the carriage from the another of the first position and the second position to the third position, halts ejecting ink from the head at the third position, and continues moving the carriage from the third position to the one of the first position and the second position without ejecting from the head.

9. The control device according to claim 1, wherein the second type of print prints is performed by moving the carriage from one of the first position and the second position to another of the first position and the second position at a second speed slower than the first speed.

10. The control device according to claim 1, wherein the threshold value is set to a value based on a diameter of each of the plurality of nozzles.

11. The control device according to claim 1, further comprising the printer.

12. A non-transitory computer readable storage medium storing a set of program instructions for a control device configured to control a printer, the printer including: a head connectable via a channel to a receptacle accommodating therein ink, the head having: a plurality of nozzles configured to eject ink; and a plurality of drive elements provided corresponding to respective ones of the plurality of nozzles; a carriage mounting the head thereon, the head being movable between a first position and a second position; and a drive source configured to move the carriage relative to a printing medium, the control device including: a memory configured to store a plurality of pieces of speed information indicating respective ones of a plurality of speeds of the carriage and a threshold value for an ink pressure that ink exerts on the head; and a controller, the set of program instructions, when installed on and executed by the controller, causing the control device to perform:

(a) acquiring print data representing an image;

(b) selecting first speed information from among the plurality of pieces of speed information according to the print data, the first speed information indicating a first speed;

(c) estimating an ink pressure related value using the print data and the first speed information, the ink pressure related value indicating the ink pressure for a first type of print, the first type of print printing the image in a printing area on the printing medium by ejecting ink from the head while moving the carriage from one of the first position and the second position to another of the first position and the second position at the first speed;

(d) determining whether the ink pressure related value reaches the threshold value;

(e) executing, in response to determining that the ink pressure related value does not reach the threshold value, the first type of print to print the image in the printing area on the printing medium; and (f) executing, in response to determining that the ink pressure related value reaches the threshold value, a second type of print to print the image in the printing area on the printing medium, the second type of print being different from the first type of print.

* * * * *